US007311221B2

(12) United States Patent
Serfaty

(10) Patent No.: US 7,311,221 B2
(45) Date of Patent: Dec. 25, 2007

(54) DISPENSER FOR SEPARATELY DISPENSING WET AND DRY PAPER IN THE SHAPE OF A CONVENTIONAL ROLL OF TOILET PAPER

(76) Inventor: Armand Serfaty, 130 W. 57th St., New York, NY (US) 10019

( * ) Notice: Subject to any disclaimer, the term of this patent is extended or adjusted under 35 U.S.C. 154(b) by 370 days.

(21) Appl. No.: 11/057,981

(22) Filed: Feb. 14, 2005

(65) Prior Publication Data

US 2005/0178780 A1 Aug. 18, 2005

Related U.S. Application Data

(60) Provisional application No. 60/544,378, filed on Feb. 13, 2004.

(51) Int. Cl.
*B65H 1/28* (2006.01)

(52) U.S. Cl. ..... 221/35; 221/283

(58) Field of Classification Search ..... 221/34, 221/35, 45, 63, 199, 283; 242/588, 588.3, 242/598.5, 598.6, 596.8
See application file for complete search history.

(56) References Cited

U.S. PATENT DOCUMENTS 2,738,898 A * 3/1956 Lee ..... 221/35
4,108,513 A 8/1978 Lander
4,535,912 A * 8/1985 Bonk ..... 221/46
4,984,530 A 1/1991 Dutton
5,660,313 A 8/1997 Newbold
5,697,577 A 12/1997 Ogden
5,988,561 A 11/1999 Mele
6,056,235 A * 5/2000 Brozinsky ..... 242/598.6
6,382,552 B1 * 5/2002 Paul et al. ..... 242/595
6,503,326 B1 * 1/2003 Mikelionis ..... 118/419
6,536,707 B2 * 3/2003 Adelakun ..... 242/598.6
6,537,631 B1 3/2003 Rivera et al.
6,659,391 B1 12/2003 Faulks et al.
6,920,999 B2 * 7/2005 Taylor et al. ..... 221/154
2005/0029280 A1 * 2/2005 Hayes et al. ..... 221/34
2005/0051568 A1 * 3/2005 Young et al. ..... 221/34

* cited by examiner

*Primary Examiner*—William A. Rivera
(74) *Attorney, Agent, or Firm*—Ladas & Parry

(57) ABSTRACT

A dispenser for wet and dry paper formed as a housing composed of a first canister for wet paper and a second canister for dry paper, the first and second canisters being separate and provided with their respective papers in isolation from one another for being removed in use from the respective canister through a dispensing opening therein. The canisters are connected together and define a cylindrical shape for the housing; and the housing is connectable to conventional brackets of toilet paper holders to permit separate dispensing of the wet and dry paper from their respective canisters.

30 Claims, 25 Drawing Sheets

DISPENSER FOR SEPARATELY DISPENSING WET AND DRY PAPER IN THE SHAPE OF A CONVENTIONAL ROLL OF TOILET PAPER

This application claims the benefit of U.S. Provisional Application(s) NO(s).: APPLICATION No(s).: 60/544,378 FILING DATE Feb. 13, 2004 and incorporates the same by reference.

FIELD OF THE INVENTION

The invention relates to a dispenser for separately dispensing wet and dry paper.

In particular, the invention relates to such dispenser in which separate canisters are provided for the wet and dry paper to keep the wet and dry paper separate from one another.

The invention also relates to a method of assembling such a dispenser.

BACKGROUND AND PRIOR ART

The following patents are related to dispensing paper from dispensers.

| | |
|---|---|
| Lander | 4,108,513 |
| Dutton | 4,984,530 |
| Newbold | 5,660,313 |
| Ogden | 5,697,577 |
| Mele | 5,988,561 |
| Rivera | 6,537,631 |
| Faulks | 6,659,391 |

Newbold shows premoistened toilet paper in a dispenser adapted to be mounted on a conventional toilet paper hold.

Rivera, Ogden, Faulks and Mele are cumulative and show similar arrangements. Lander shows dispensing toilet paper from two separate rolls. Dutton shows two rolls of paper separately delivered from a common dispenser.

SUMMARY OF INVENTION

An object of the invention is to provide a dispenser for wet and dry paper in which separate canisters are utilized for the wet and dry paper and when assembled the canisters form a configuration which corresponds to a conventional roll of toilet paper.

Another object of the invention is to provide a dispenser in which the canisters are easily replaced when they become empty.

A further object of the invention is to provide such a dispenser which can replace the conventional roll of toilet paper and use the same brackets or lugs to mount the dispenser.

In order to achieve these and further objects, the invention provides for a dispenser for separate dispensing of wet and dry paper comprising a common housing formed by a first canister for wet paper and a second canister for dry paper, the first and second canisters being shaped to provide said housing with the shape of a toilet paper roll in which the wet paper and the dry paper can be separately dispensed.

In accordance with a feature of the invention, the paper is encapsulated in the wet paper container to prevent evaporation.

According to another feature, the first and second canisters have separate dispensing openings for the wet paper and the dry paper, respectively.

According to another feature, the wet paper and the dry paper are isolated in their respective canisters so that they cannot contact one another.

According to another feature, said housing includes means for engaging the brackets for a conventional toilet paper holder to secure the housing to the brackets.

In further accordance with the invention, there is contemplated a shelf including means for securing the shelf in bores in the brackets which normally can support a holder for a toilet paper roll. First and second canisters are provided for wet paper and dry paper. The canisters have a respective opening for removing the paper therefrom. The canisters are mounted on the shelf on opposite sides thereof and have respective surfaces of part-cylindrical shape cooperatingly forming a cylindrical outline simulating a roll of toilet paper.

According to another feature of the invention, each canister is replaceably mounted on the shelf.

In further accordance with the invention, there is contemplated a housing including a first canister for wet paper and a second canister for dry paper, the first and second canisters being separate and provided with their respective paper in isolation from one another for being removed in use from the respective canister through a dispensing opening therein. The canisters are connected together and define a cylindrical shape for the housing. The housing is connected to connection brackets for a toilet paper holder to secure the housing to the brackets and permit separate dispensing of the wet and dry paper from their respective said dispensing openings of the canisters.

According to a further feature of the invention, the first and second canisters have aligned bores when the canisters are engaged with one another to receive an elastically telescoping rod which can be engaged in the brackets.

According to a further feature of the invention, laterally extending tabs are provided for engaging the brackets to oppose rotation of the housing with respect to the brackets.

In further accordance with the invention, there is provided a method by which separate dispensing of wet paper and dry paper can be obtained from a common dispenser, the method being achieved by the steps of providing a first canister containing wet paper, the canister having an opening from which the wet paper can be removed; providing a second canister containing dry paper, the second canister having an opening from which the dry paper can be removed; assembling the canisters and mounting them in bores in brackets normally used for supporting a conventional toilet paper holder; detachably connecting the first and second canisters in the assembly with the openings thereof accessible from the front; and forming the canisters with domes of semi-cylindrical shape so that when the canisters are mounted on the brackets, the canisters form a cylindrical shape.

According to a further feature of the invention, the first canister for wet paper forms a hermetic enclosure for the wet paper.

According to a further feature of the invention, the canisters are formed such that they can be interchangeably mounted on the top or bottom of the assembly.

DETAILED DESCRIPTION

Figure 1:
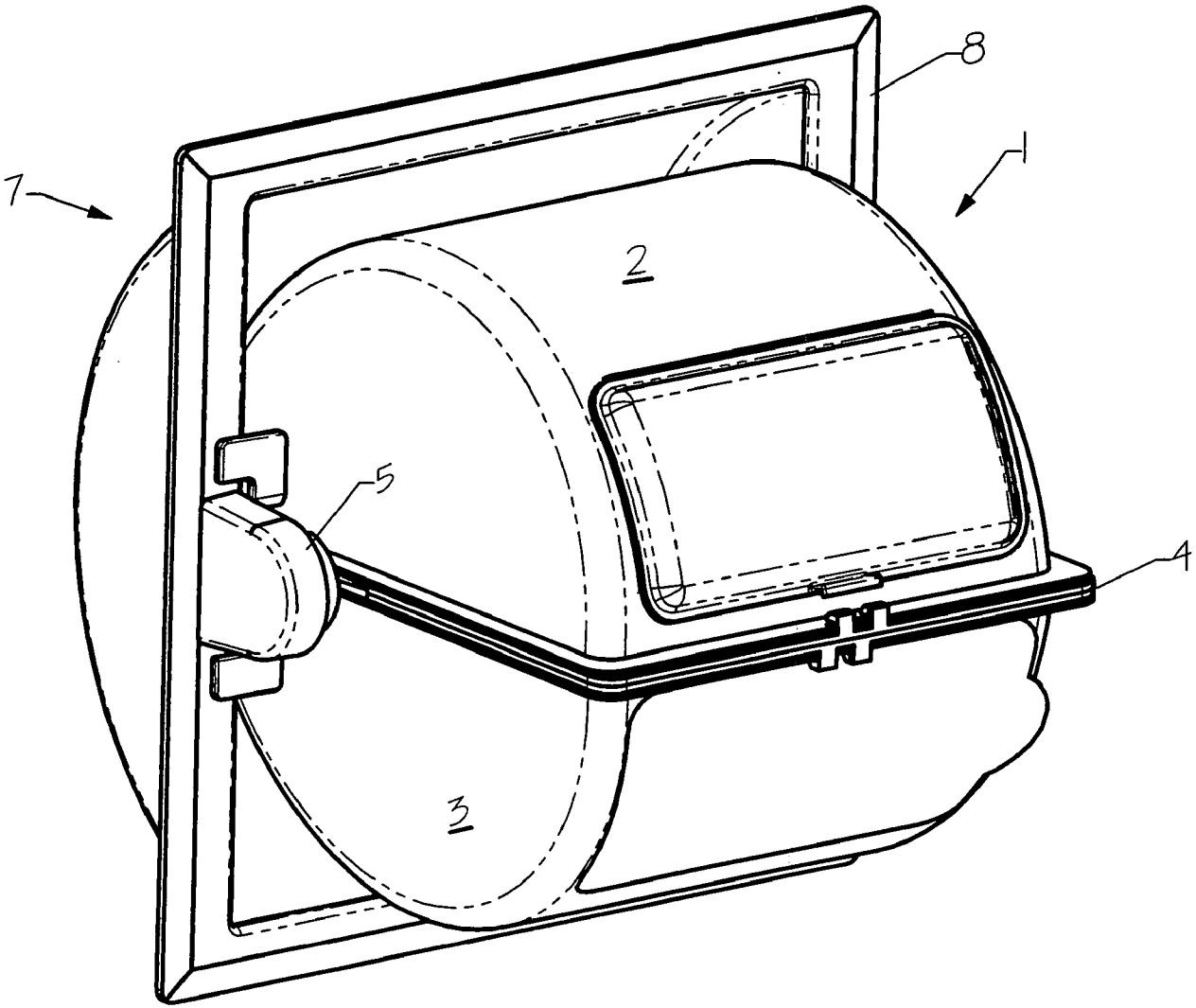
FIG. 1 is a front perspective view of a first embodiment of a dispenser for wet and dry paper according to the invention.

In FIG. 1, there is seen a first embodiment of a dispenser 1 of the invention which comprises a canister 2 containing moistened paper (hereafter referred to as wet paper) and a canister 3 containing dry paper such as toilet paper. The wet paper and dry paper are supported in their respective canisters for being dispensed therefrom through respective openings as will be seen later.

The canisters 2, 3 are each of semi-cylindrical shape and are connected together to form the dispenser 1 as a casing or housing of cylindrical shape simulating a conventional roll of toilet paper. This will enable the housing to be installed in conventional support structures normally used to support a roll of toilet paper as will be seen later.

Figure 2:
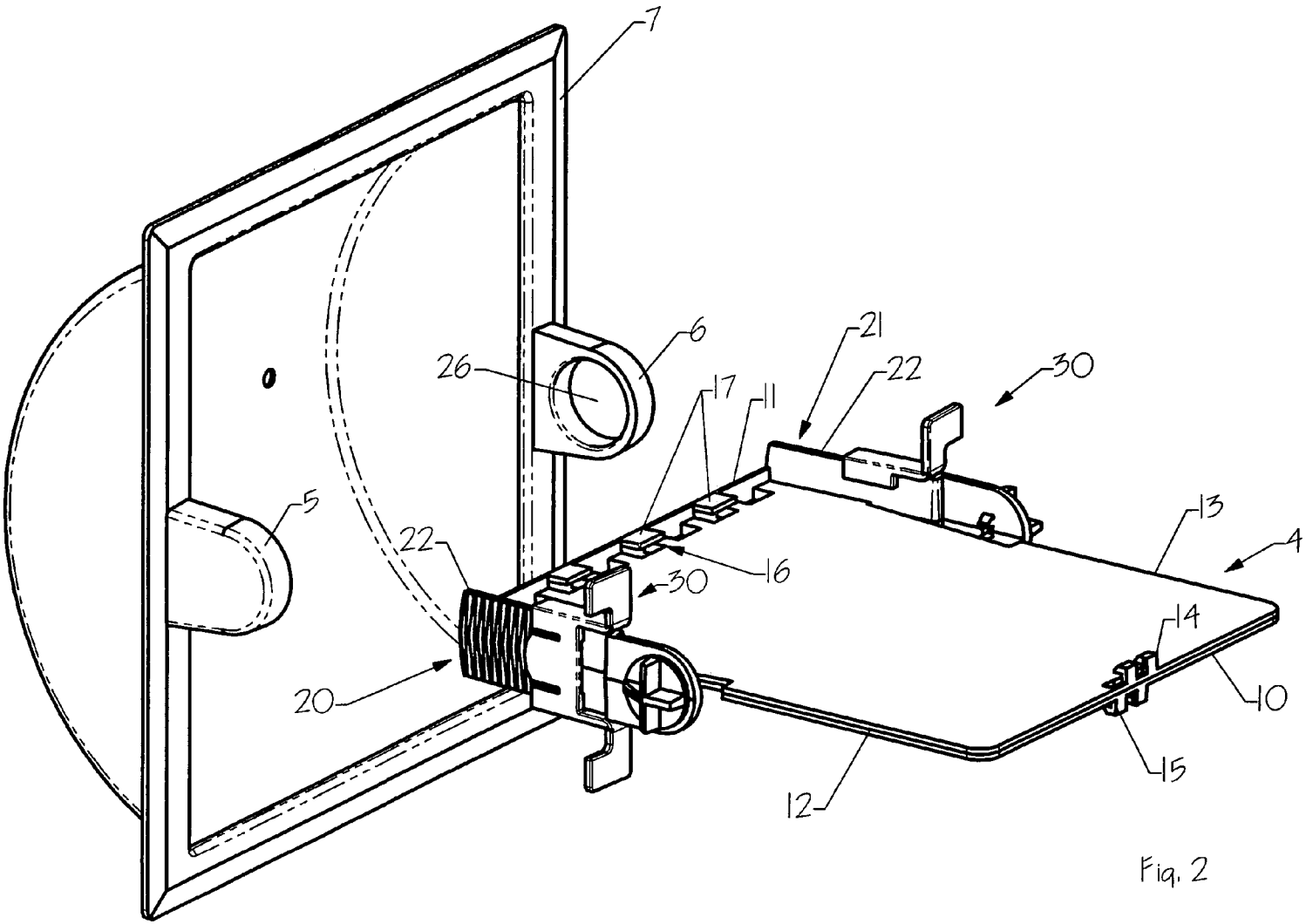
FIG. 2 is an exploded view showing a shelf of the dispenser separated from a holder of the dispenser.
Figure 3:
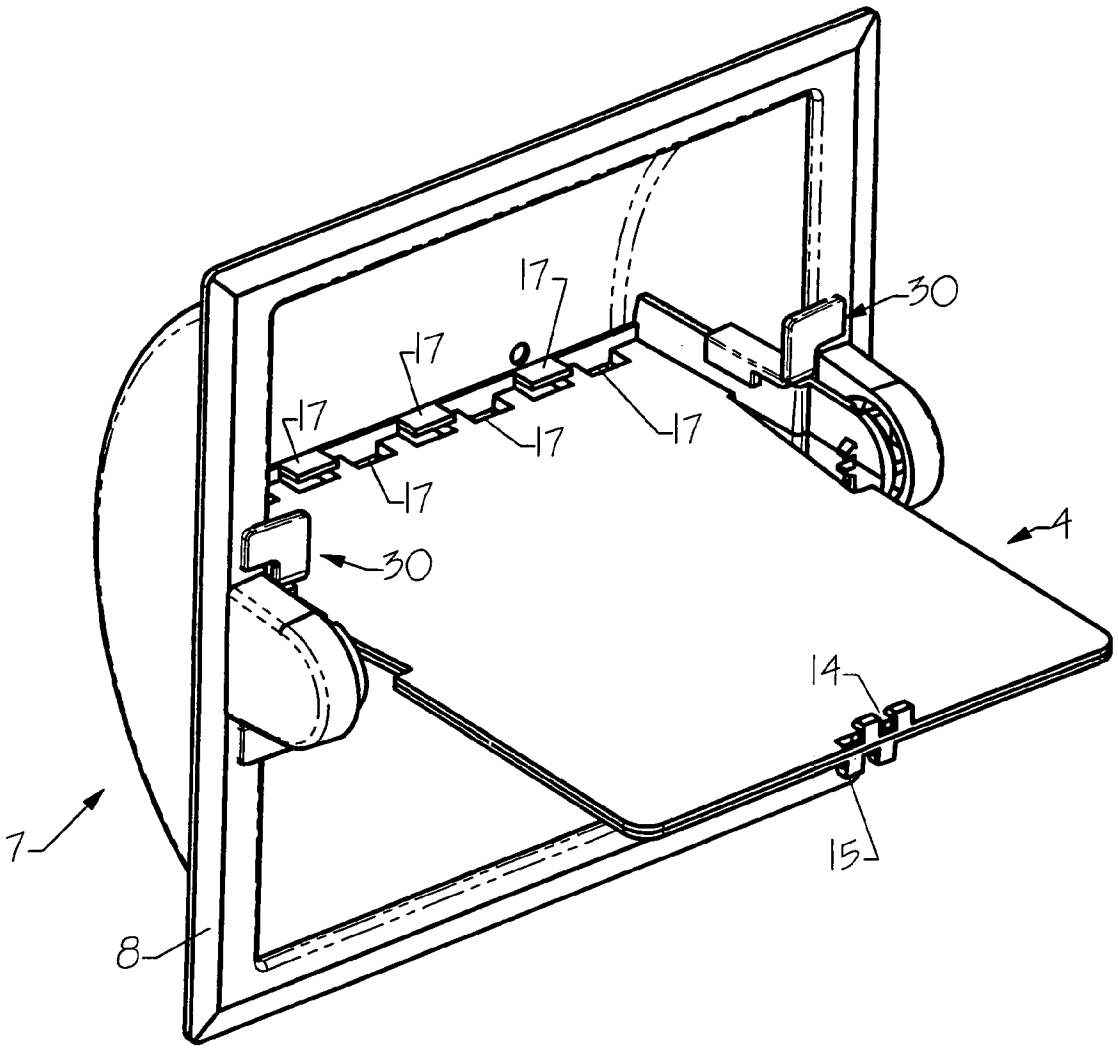
FIG. 3 shows the shelf supported in the holder.

The canister 2 and 3 are mounted on a shelf 4 which serves to connect the dispenser 1 to conventional brackets or lugs 5, 6 (FIG. 2) which normally support a conventional rod for a roll of toilet paper.

The lugs or brackets are secured to a support that can take many forms. For illustrative purposes, the invention will be described with reference to a conventional concave holder 7 which is secured in a hole in a wall and which includes a frame 8 adapted to abut against the edge of the hole in the wall. The wall for the holder 7 can be the wall of a cabinet or the wall in a bathroom or other location where the dispenser 1 is installed. The lugs 5, 6 can be secured to the supporting wall in other ways as well known in the art without the need for detailed explanation. However, in all cases, lugs 5, 6 project from the supporting wall for normally supporting the rod for holding a roll of toilet paper.

The canister 2 for wet paper is intended to supply individual or continuous sheets of wet paper, such as "wet wipes" or the like while the canister 3 is intended to supply dry paper in the manner of conventional toilet paper or individual sheets. The moistened or wet paper can be moistened by a liquid, generally water based, which can contain medicaments, cleansing agents, scenting agents or the like depending on the ultimate use.

Referring to FIGS. 2-5, the shelf 4 is seen as being formed as a flat member having a front edge 10, a rear edge 11, and side edges 12 and 13. At the front edge 10, there are formed latch members 14, 15 which are offset from one another to latch the canisters 2, 3 as will be explained later. At the rear edge 11, the shelf is formed with a rear wall 18 from which hooks 17 extend respectively at the top and bottom surfaces of shelf 4 to overlie the shelf. The hooks at the top surface of the shelf are visible at 17 and the hooks at the bottom surface of the shelf are the same and are interspaced with hooks 17 at the top surface of the shelf. The shelf 4 is formed with castellations 16 at the rear edge, and rear wall 18 closes the back of the shelf 4.

Figure 9:
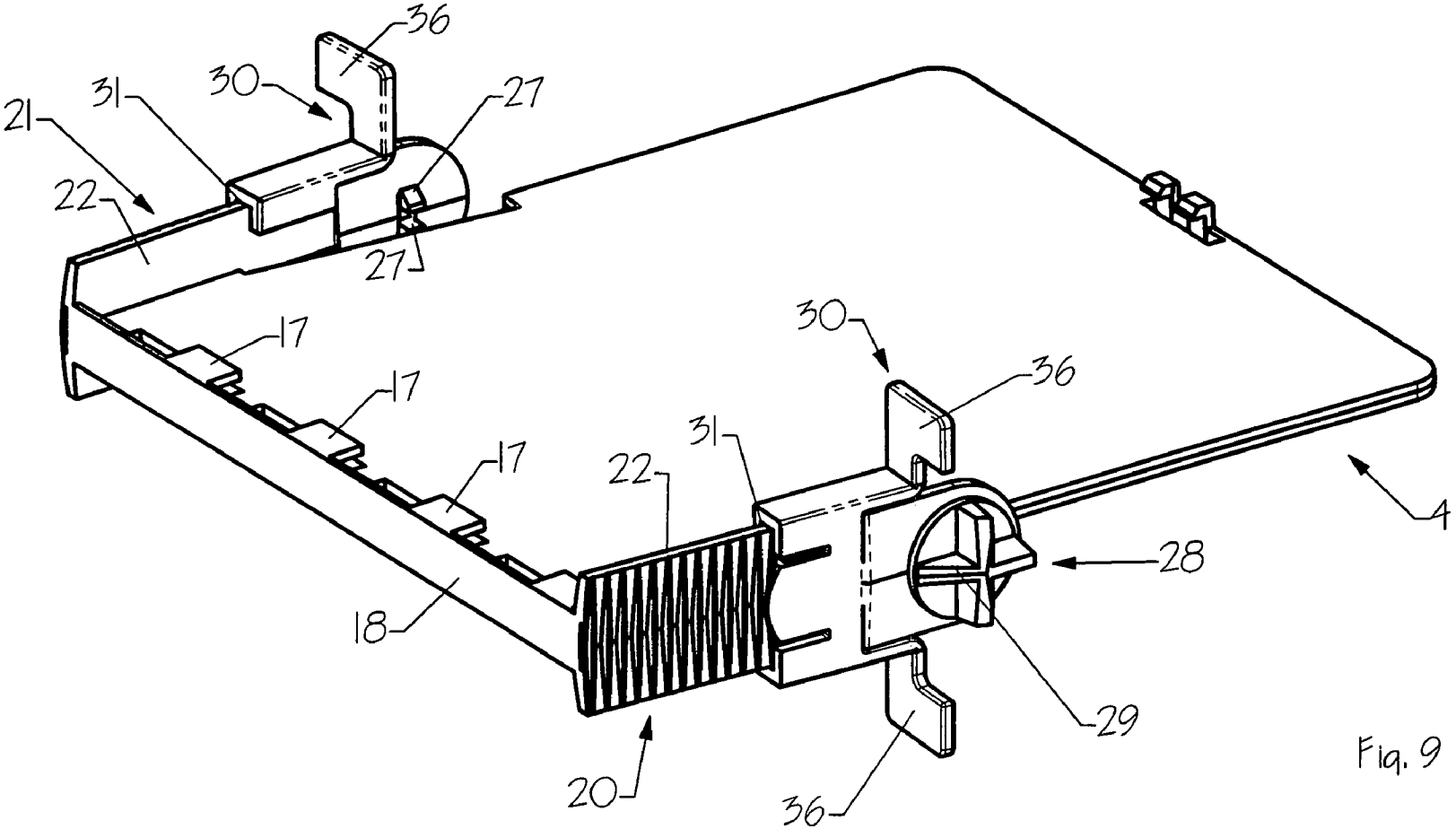
FIG. 9 is a rear view showing the tab locks installed on the shelf.

The shelf 4 is formed with engagement members 20, 21 at the side edges 12, 13 and the engagement members 20, 21 are integral with the rear wall 18 (as best seen in FIG. 9). The engagement members 20, 21 serve as a means to secure the shelf 4 to lugs 5, 6.

Figure 4:
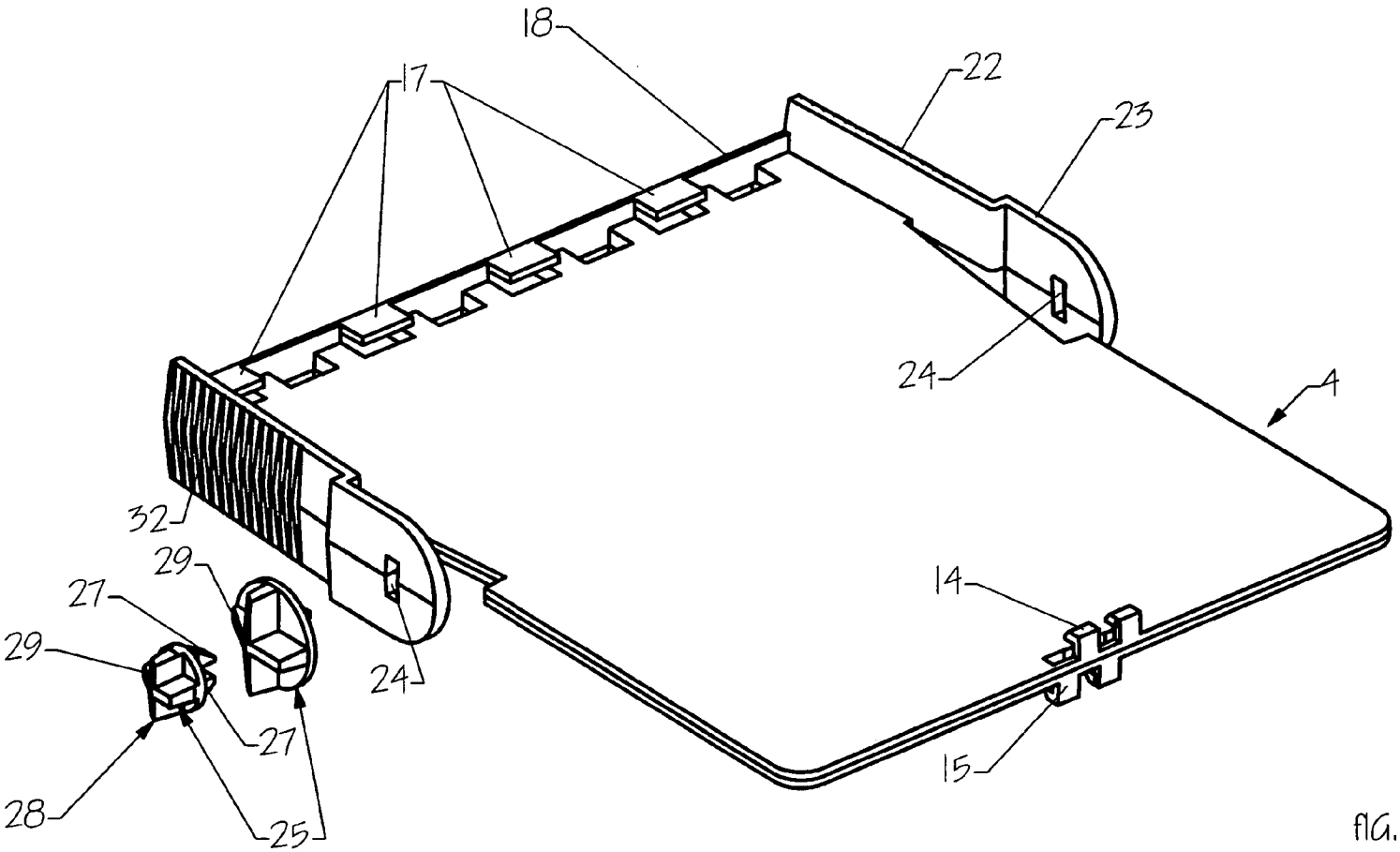
FIG. 4 shows the shelf in readiness to receive a support stud.
Figure 5:
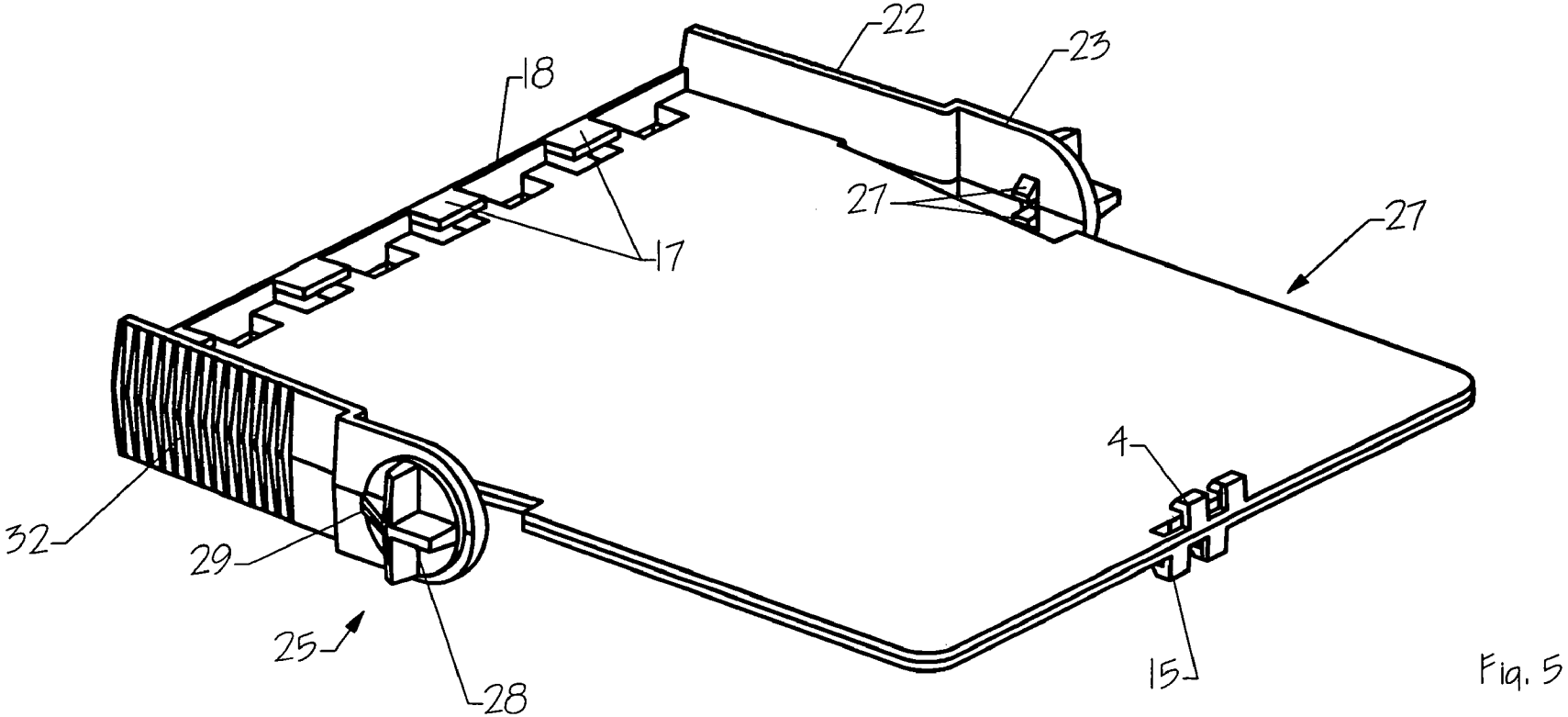
FIG. 5 shows the shelf of FIG. 4 with studs installed thereon.
Figure 6:
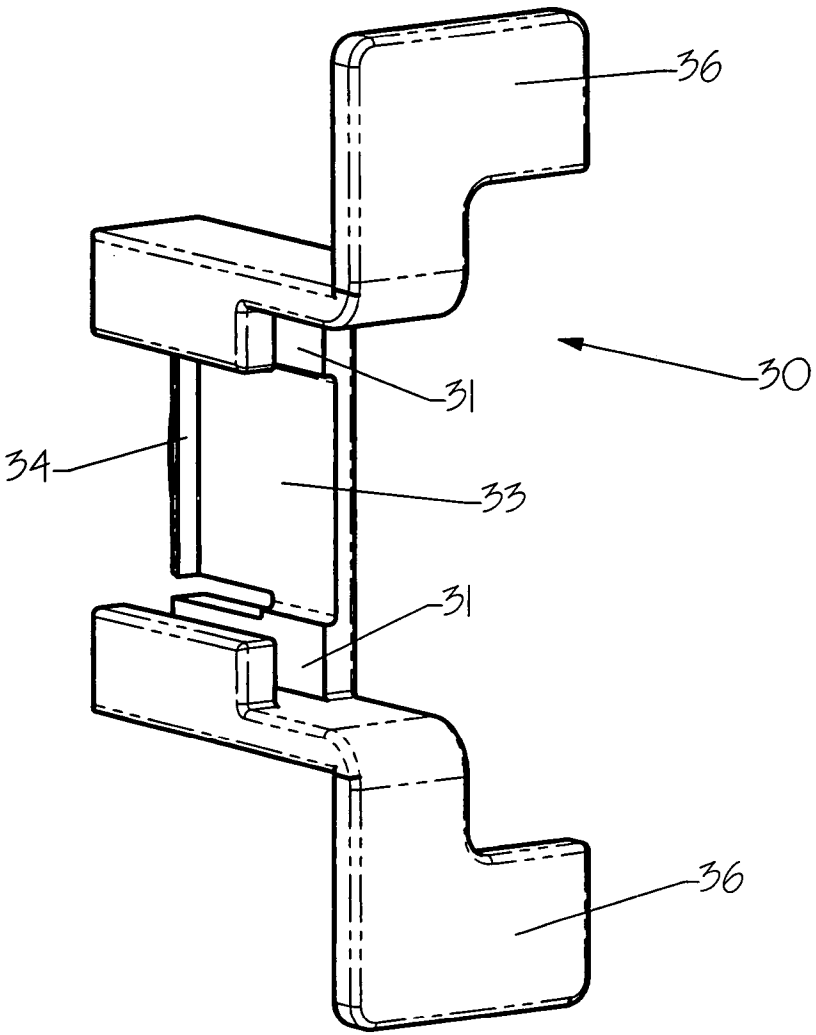
FIG. 6 is a perspective view of a tab lock for the dispenser.

As clear from FIG. 4, each engagement member 20, 21 includes a portion 22 integral with the rear wall 18 of the shelf and a wing 23 which extends from portion 22 and is laterally offset outwardly therefrom to provide some degree of elasticity of the wing to enable lateral elastic displaceability. The wing 23 is provided with a slot 24.

In order to enable the shelf 4 to be engaged in lugs 5, 6, a plurality of different size studs 25 are provided which are intended to be fitted in blind bores or holes 26 in lugs 5, 6.

After selecting the particular size of the stud 25 which fits in the blind bore 26, a pair of resilient locking claws 27 provided on the back side of the studs are snapped into slot 24 to lock against the upper and lower edges of slot 24. The stud 25 has an outer projecting portion 28 of T-shape with a rearwardly projecting cam 29 of triangular shape.

Figure 7:
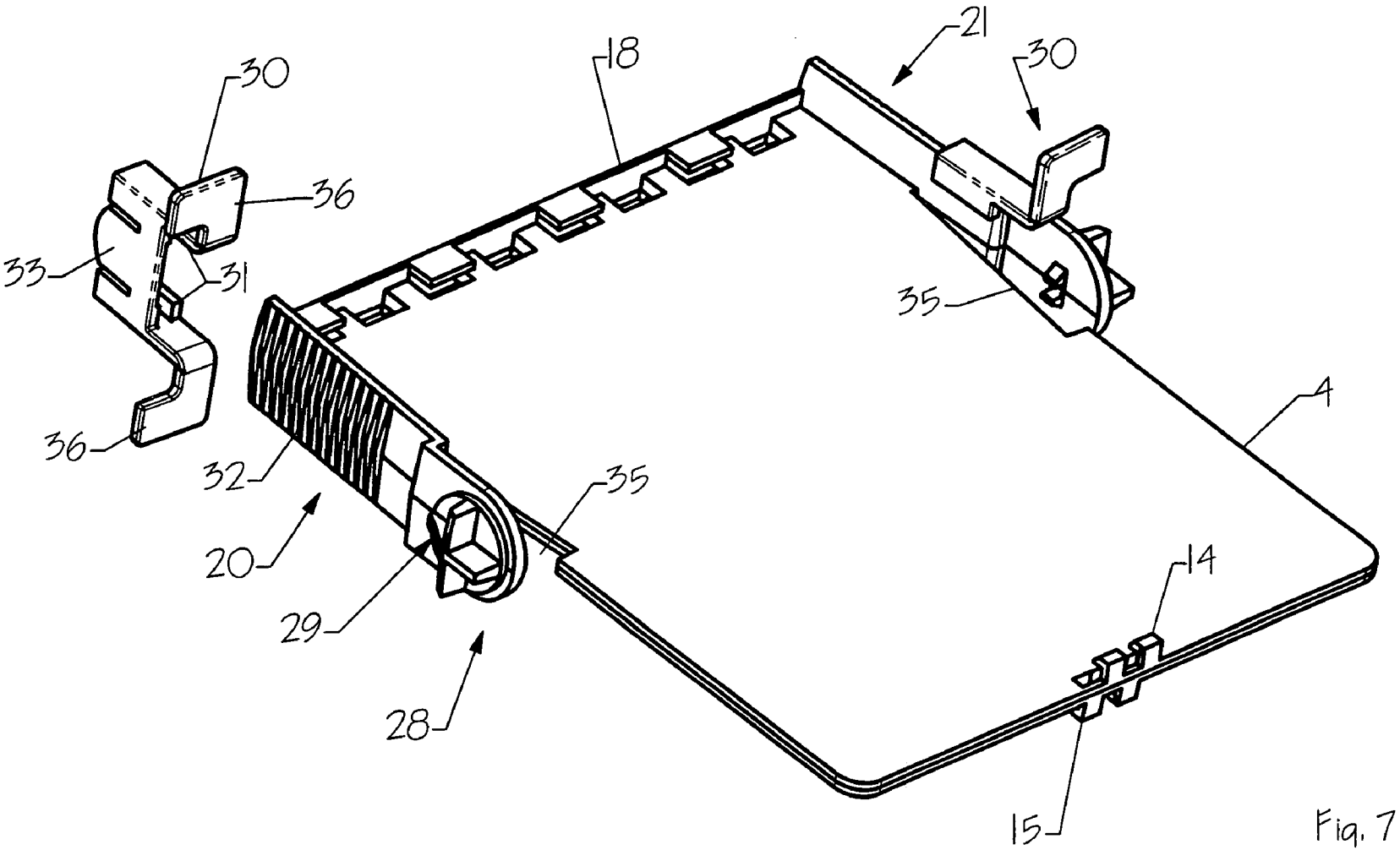
FIG. 7 shows the shelf with the tab lock at the left edge in preparation for installation on the shelf while the tab lock at the right edge is installed on the shelf.
Figure 8:
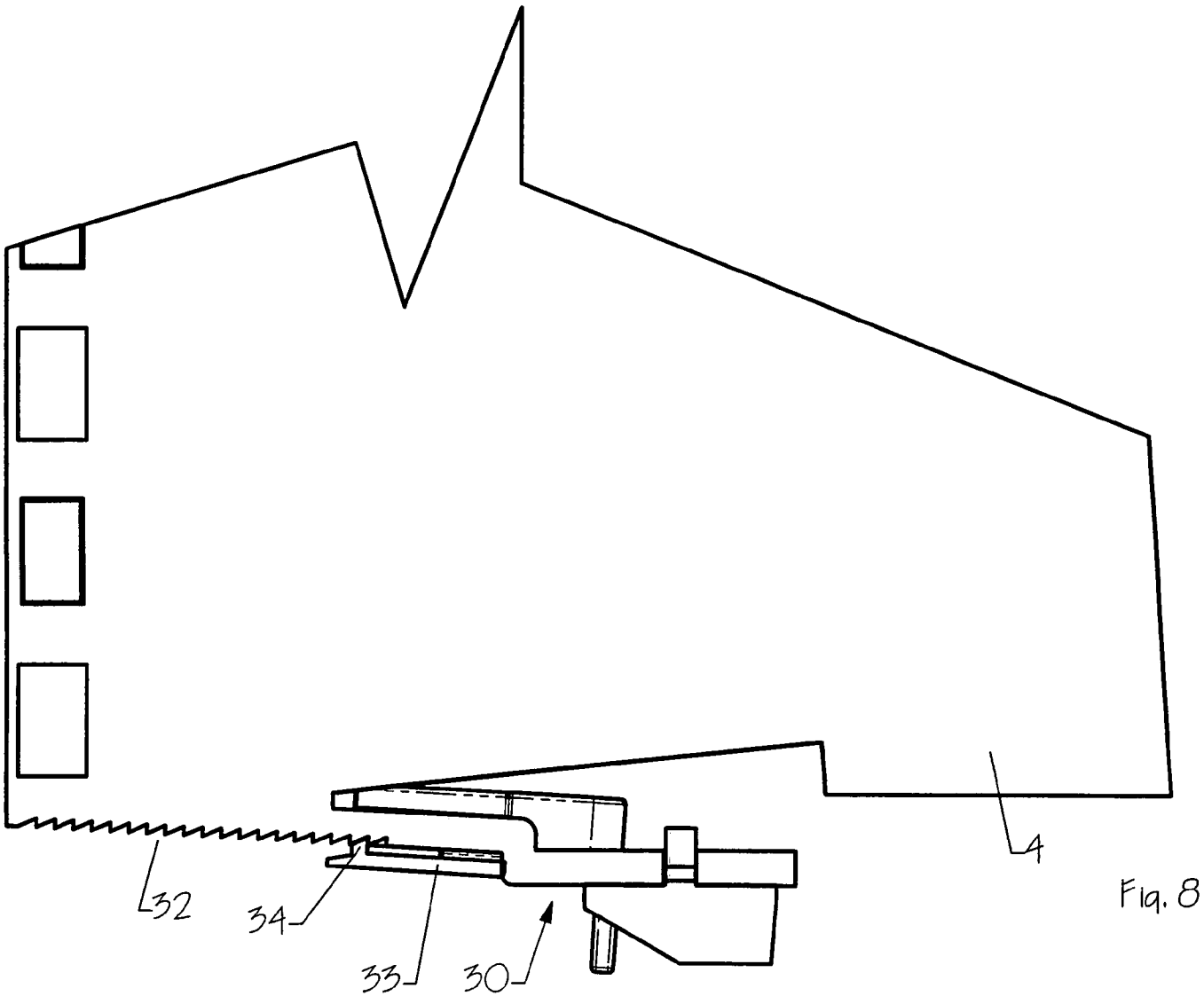
FIG. 8 is an enlarged top plan view of a portion of the left side of the shelf showing the engagement of the tab lock on the shelf.

A pair of tab locks 30 are provided at the opposite sides of the shelf 4 and are mounted on the portions 22 of the engagement members 20, 21. In FIG. 7, the tab lock 30 at the left side of the shelf is shown in readiness for being mounted on engagement member 20 while the tab lock 30 at the right edge 9 of shelf 4 is mounted on engagement member 21.

Each tab lock 30 is provided with grooves 31 at its top and bottom to slidably ride on the top and bottom edges of portion 22 of the respective engagement members 20, 21. The outer face of portion 22 is formed with a series of ratchets 32 and the tab locks 30 have flexible tongues 33 with an inwardly facing locking tooth 34 at its end for lockingly engaging the ratchet.

Figure 10:
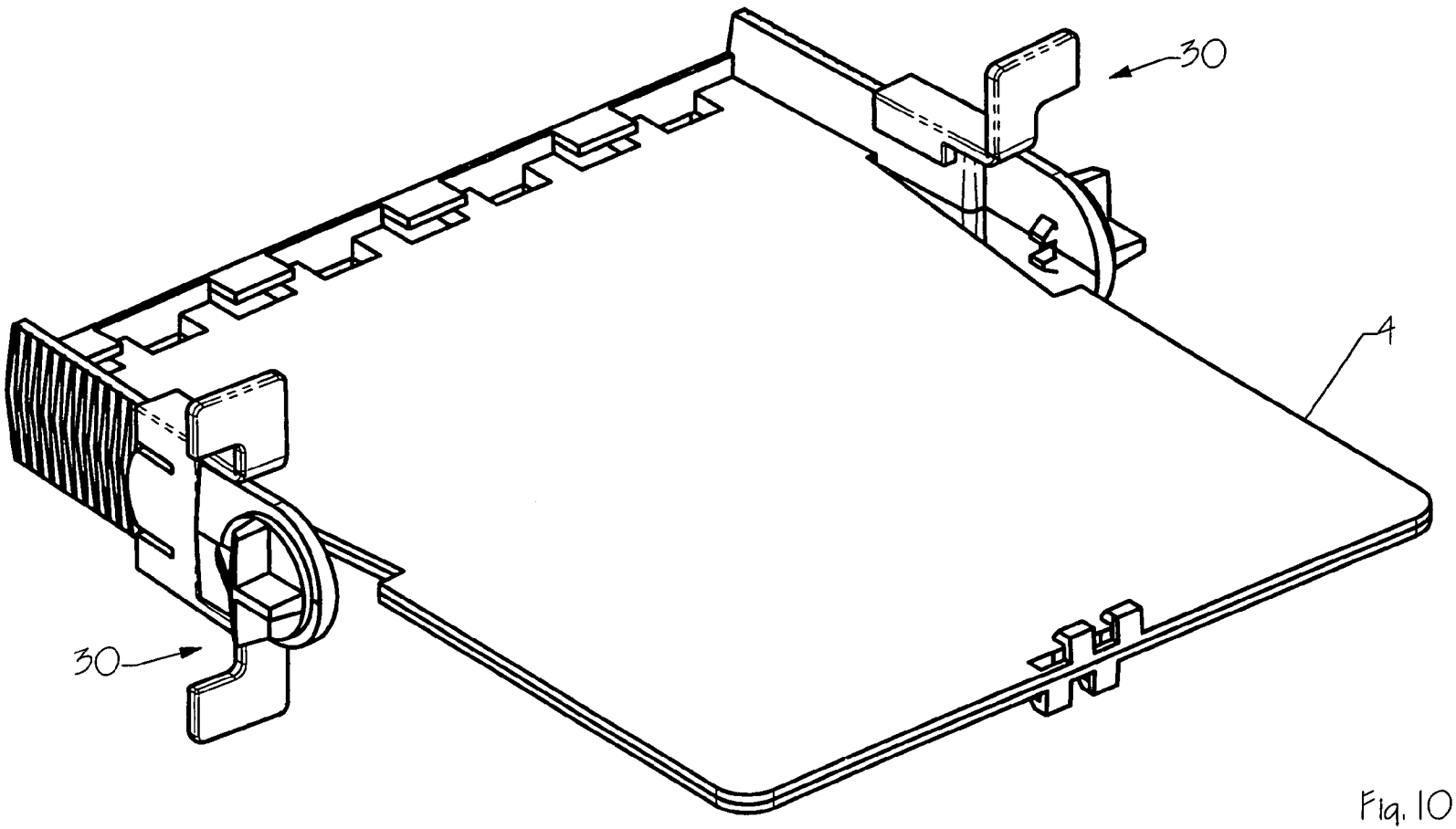
FIG. 10 shows the shelf with the tab locks installed and ready to be inserted into the holder.
Figure 11:
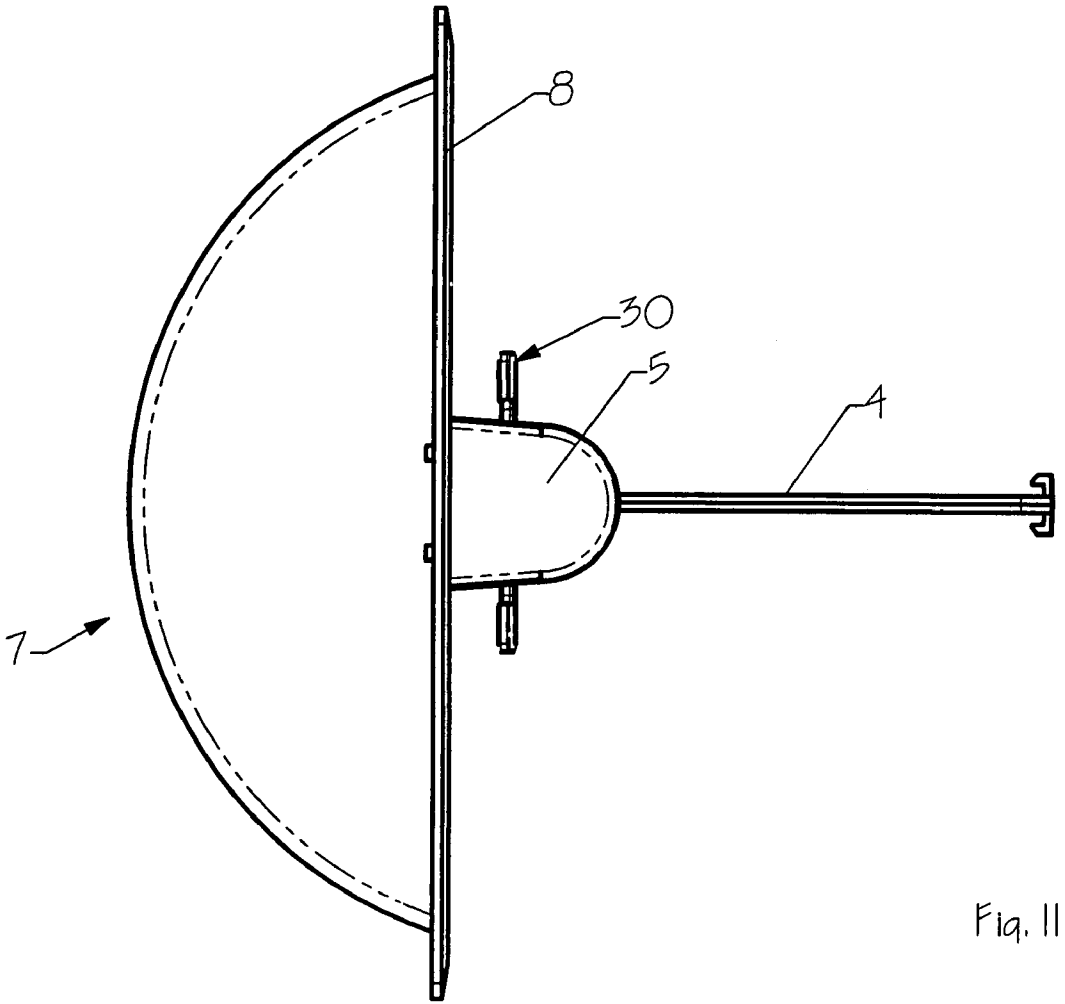
FIG. 11 is a side view showing the shelf supported in the holder with the tab locks retracted.
Figure 12:
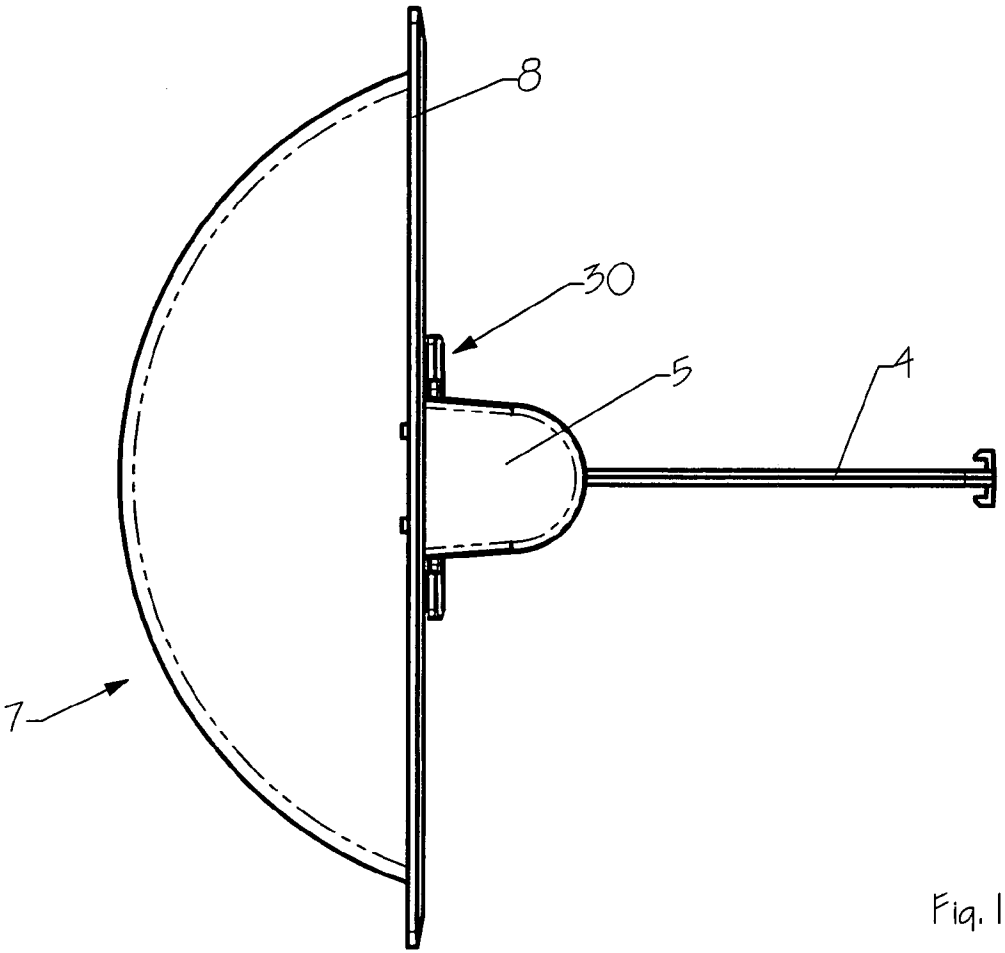
FIG. 12 shows the tab locks after being pushed against the frame of the holder.
Figure 13:
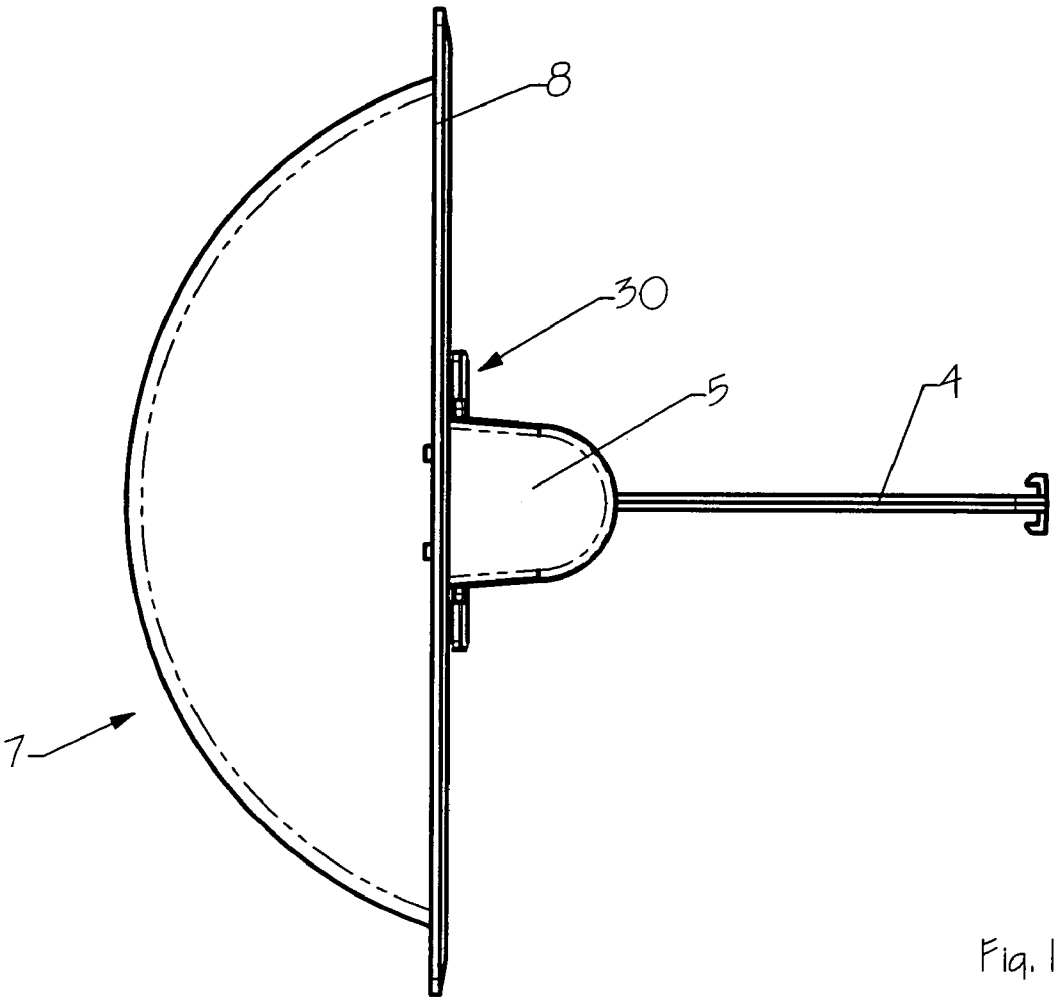
FIG. 13 is a perspective view of FIG. 12.

After the tab locks 30 have been installed on the portions 22 of the engagement members 20, 21 (as shown in FIGS. 9 and 10), the shelf is ready to be installed in the lugs 5, 6. To achieve this, the rear edge 11 of the shelf is inserted into the hollow of holder 7 causing the cams 29 to contact the lugs 5, 6 and force the wings 23 inwardly. The shelf is provided with slots 35 facing the wings 23 to accommodate the inward displacement of the wings. When the outer projecting portions 28 of the studs 25 reach the blind bores 26 in the lugs 5, 6, the projecting portions 28 snap into the blind bores and secure the shelf in the lugs. The tab locks 30 are then slidably moved rearwardly until outwardly facing flanges 36 of the tab locks bear against the frame 8 of the holder 7 as seen in FIGS. 12 and 13. The locking teeth 34 on tongues 33 are now engaged with the ratchets 32 and the shelf is tightly secured to the lugs.

The canisters 1, 2 are now ready to be secured to the shelf 4 to complete the assembly as will be explained hereafter.

Figure 14:
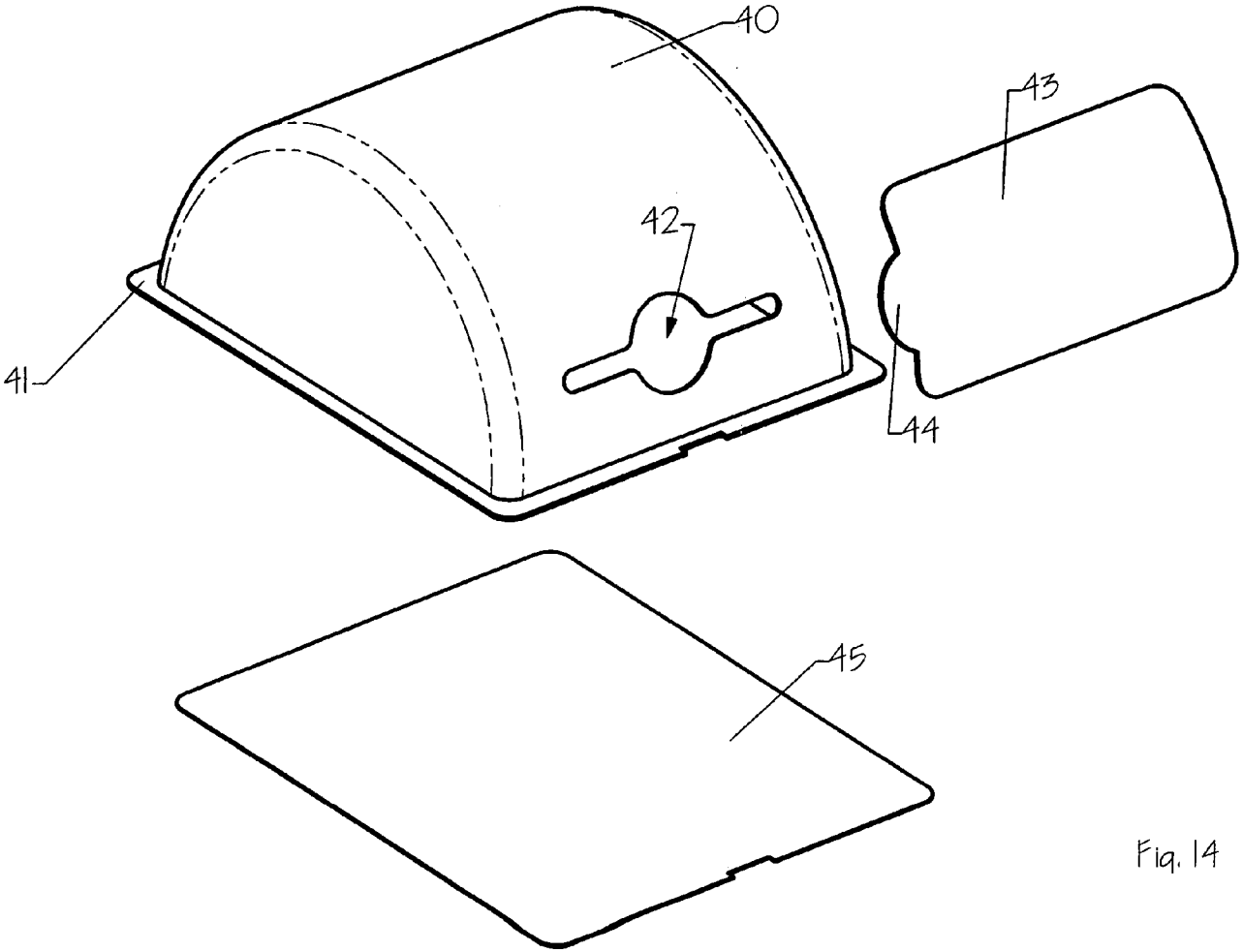
FIG. 14 is an exploded view of a canister for dry paper.
Figure 15:
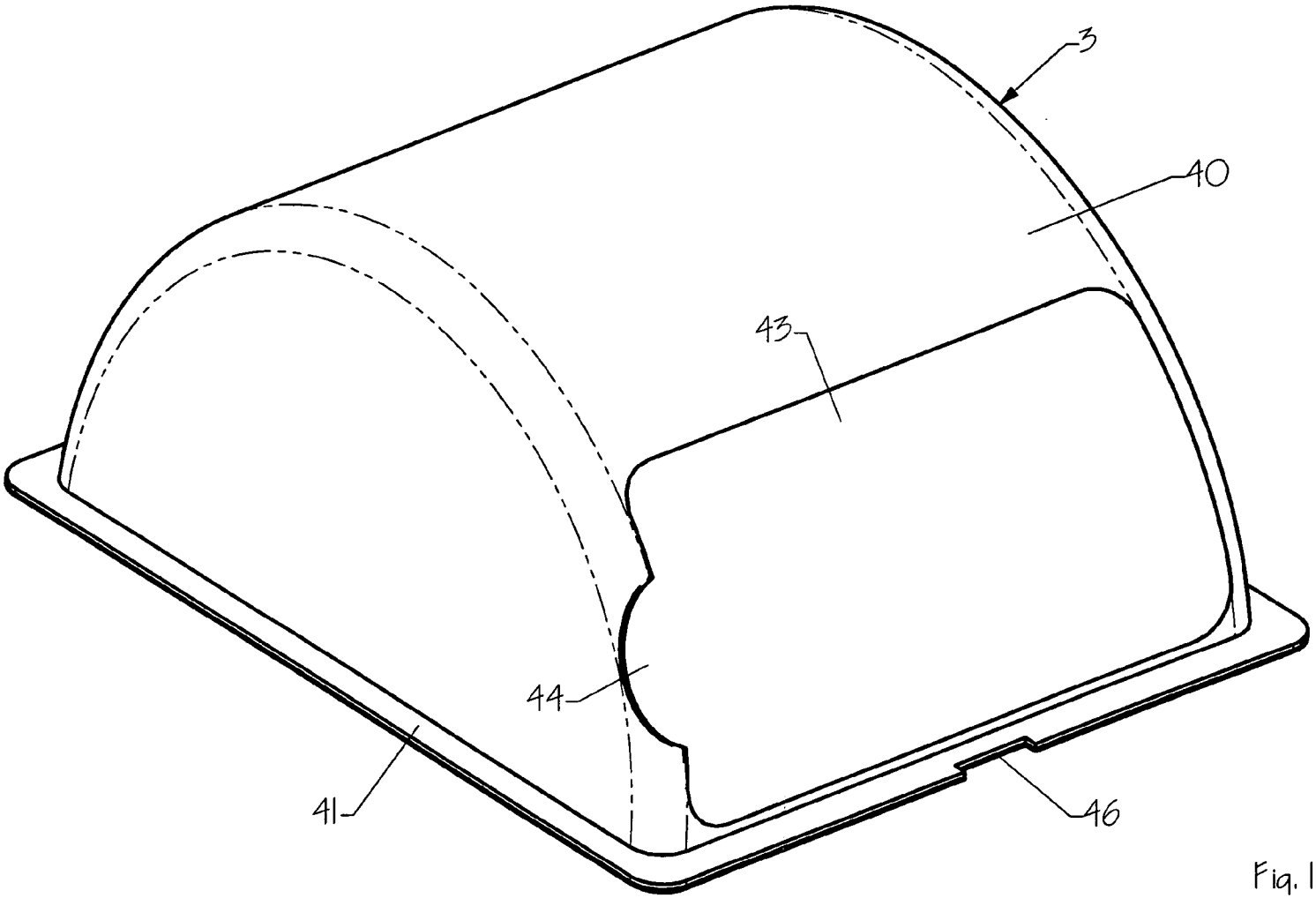
FIG. 15 shows the assembled dry paper canister.

FIG. 14 is an exploded view of the dry paper canister 3 which includes a semi-cylindrical cover 40 of dome shape and a flat base 41 on which the cover 40 is formed. The canister 3 is preferably made of thin plastic material which can be injection molded. Dry paper (not shown) is interleaved or otherwise connected and placed in the canister so that the paper can be extracted either as individual sheets or as a continuous sheet through a dispensing opening 42. The dispensing opening 42 is closed by a removable peel-off cover 43 of sheet form which has a tab 44 to enable removal of the cover 43 when the canister is installed and ready for first use.

The base 41 is slightly greater in extent than the bottom edge of the cover 40 to extend therearound. The base 41 is affixed on a deck 45 having the same size as the base 41. The base and deck can be integrally formed with one another and made as a single part integrated with cover 40. At the front edge of the canister 3 there is formed a slot 46 adapted to engage latch member 15.

Figure 18:
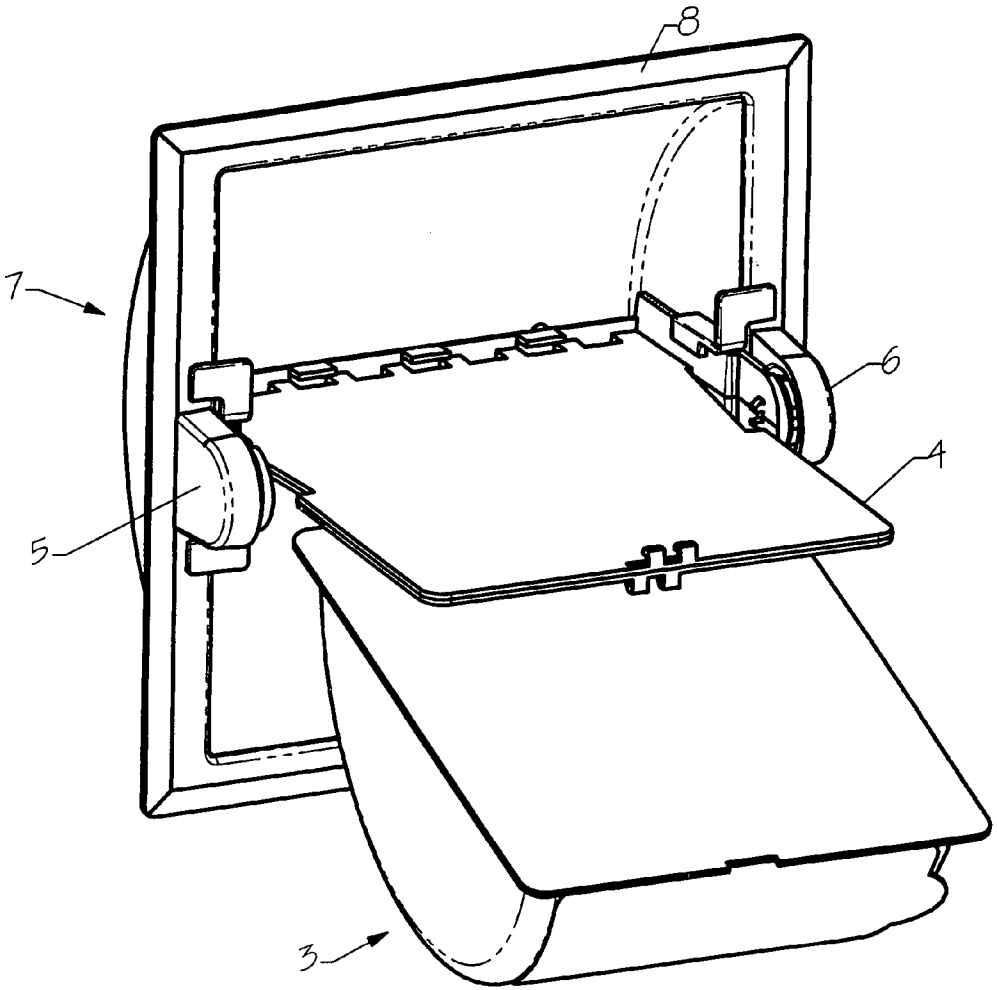
FIG. 18 shows the manner of installation of the dry paper canister.
Figure 19:
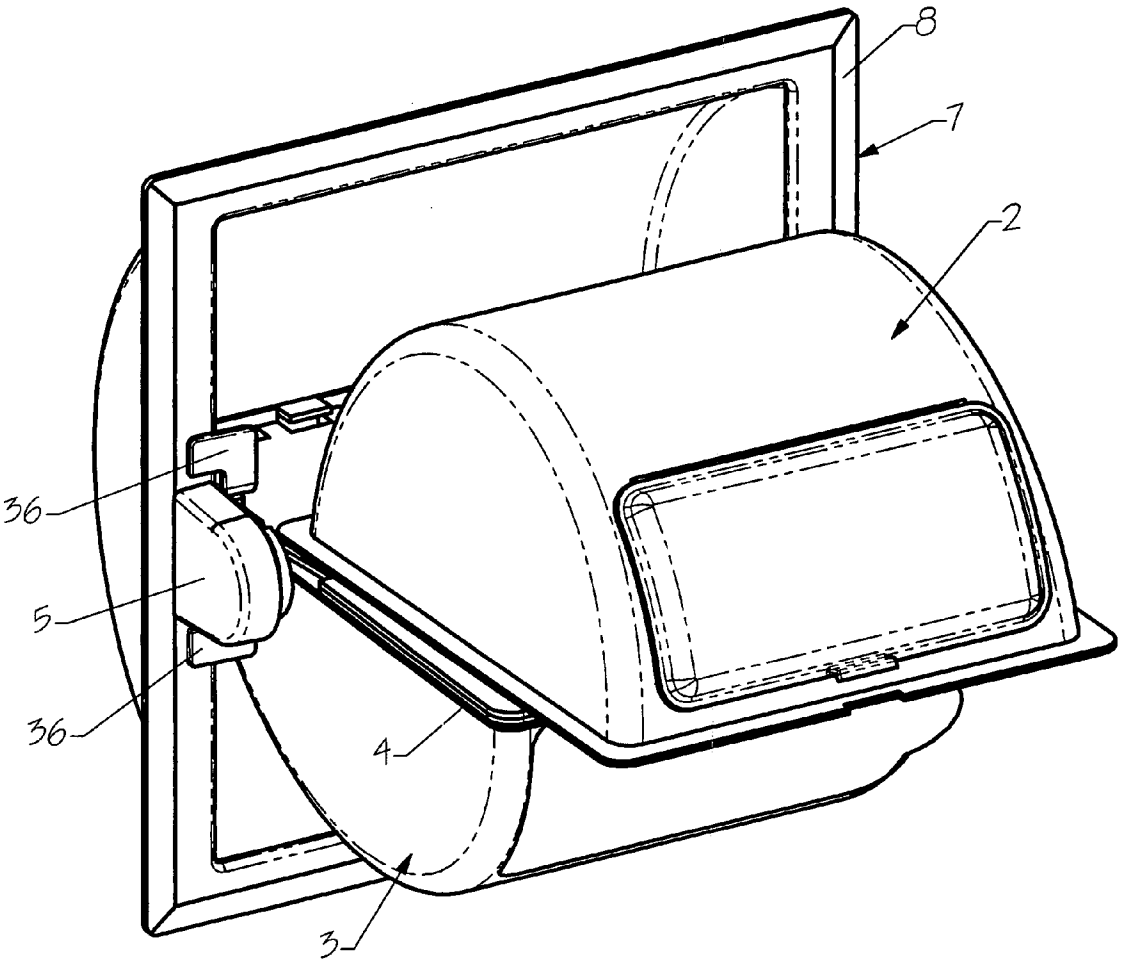
FIG. 19 shows the manner of installation of the wet paper canister.

In order to assemble the canister 3 on the shelf 4, reference is made to FIGS. 18 and 19 wherefrom it can be seen that the rear edge of the base and deck of the canister is engaged beneath the hooks 17 whereafter, and the slot 46 is latched to latch member 15.

Figure 16:
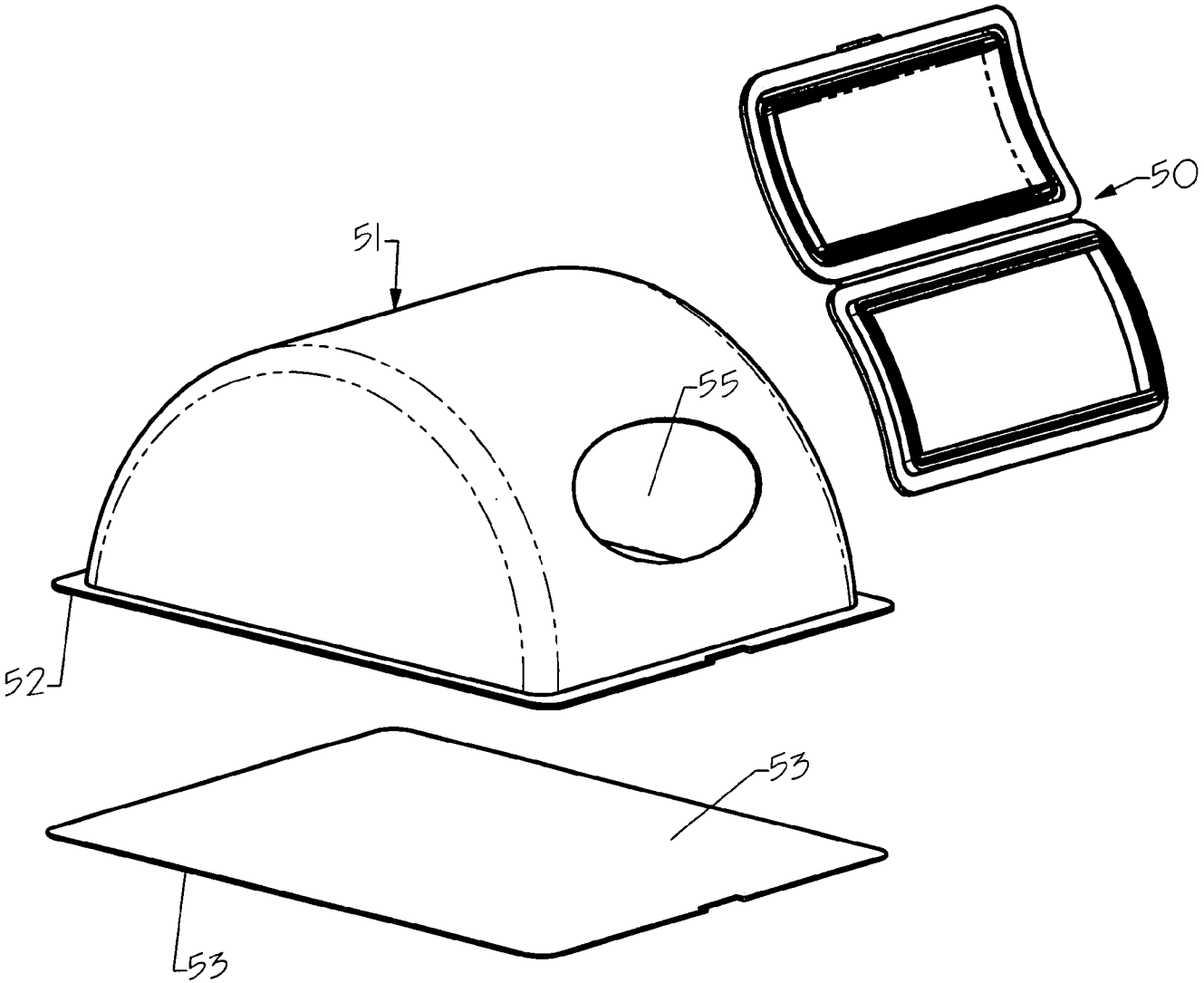
FIG. 16 is an exploded view of a wet paper canister.
Figure 17:
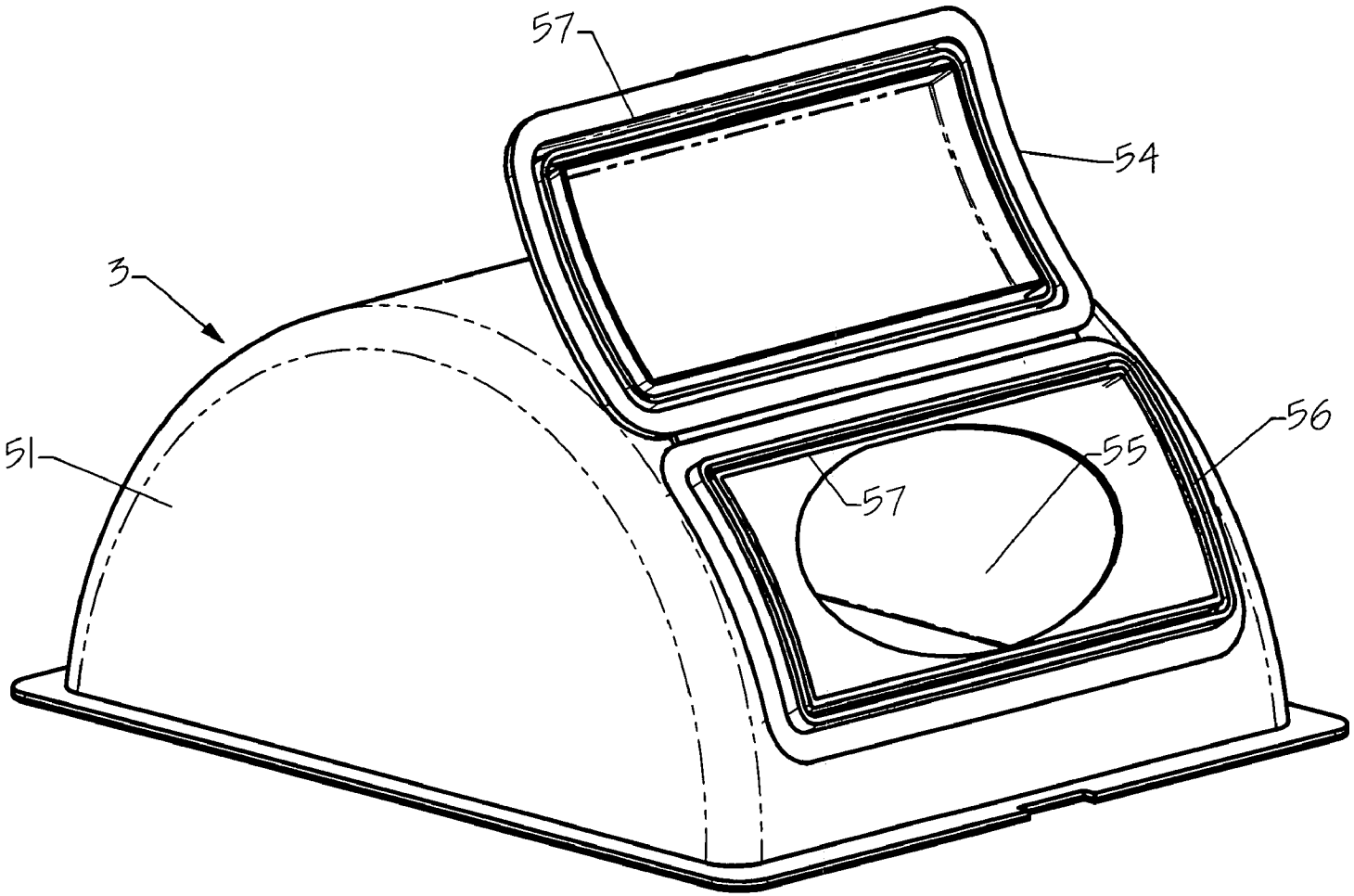
FIG. 17 shows the assembled wet paper canister.

FIGS. 16 and 17 show the construction of the canister 2 for wet paper and it is evident that this construction is similar to that of the dry paper canister. However, the wet paper canister must be hermetically enclosed to prevent evaporation of the liquid from the wet paper. To this end, a closable, sealable door assembly 50 is provided. As with the dry paper canister 3, the wet paper canister 2 has a semi-cylindrical cover 51, a base 52, and a deck 53, and the assembled wet paper canister 2 is shown in FIG. 17. In FIG. 17, a door 54 of door assembly 50 is shown in open position to expose dispensing opening 55 from which wet paper sheets can be removed. After removal of the desired number of wet paper sheets, the door 54 is closed. The door 54 and the frame 56 to which it is hingeably attached are provided with seals 57 extending all around the opening in the door and frame so that when the door is closed, the door assembly will be hermetically sealed. The opening 55 in the cover 51 is larger than opening 42 in the canister 3 to facilitate the removal of the wet paper from the canister.

After the dry paper canister 3 has been installed, the wet paper canister 2 is installed on the shelf 4, similar to that of canister 3 as shown in FIG. 19.

The order of installation of the canisters can be reversed.

Although the wet paper canister 3 has been shown mounted on top of the shelf, it is also possible to interchange the location of the canisters by inverting the shelf 4 and mounting the dry paper canister 3 on top of the shelf and the wet paper canister on the bottom of the shelf.

It is to be noted that the latch members 15, 16 are slightly offset from one another to engage respective slots 46 at the front edges of the canisters, which are correspondingly offset. In this way, the canisters can be inserted in only one configuration with respect to the shelf 4. Accordingly, once the shelf 4 is installed, the location of the canisters (top or bottom) is fixed. However, should it be desired to reverse the location of the canisters, it is only necessary to remove the shelf and invert it as previously stated.

As evident from the above, when a canister becomes empty, it is easily replaced with a full one by unlatching the front of the empty canister and sliding the canister forwardly to extract the rear edge from the hooks 17 at the rear edge of the shelf. The full canister is then installed by a reverse operation.

While the openings in the canisters for removing paper therefrom are shown at the front of the canisters, the openings can be located in other locations such as the top of the upper canister and the bottom of the lower canister.

Figure 20:
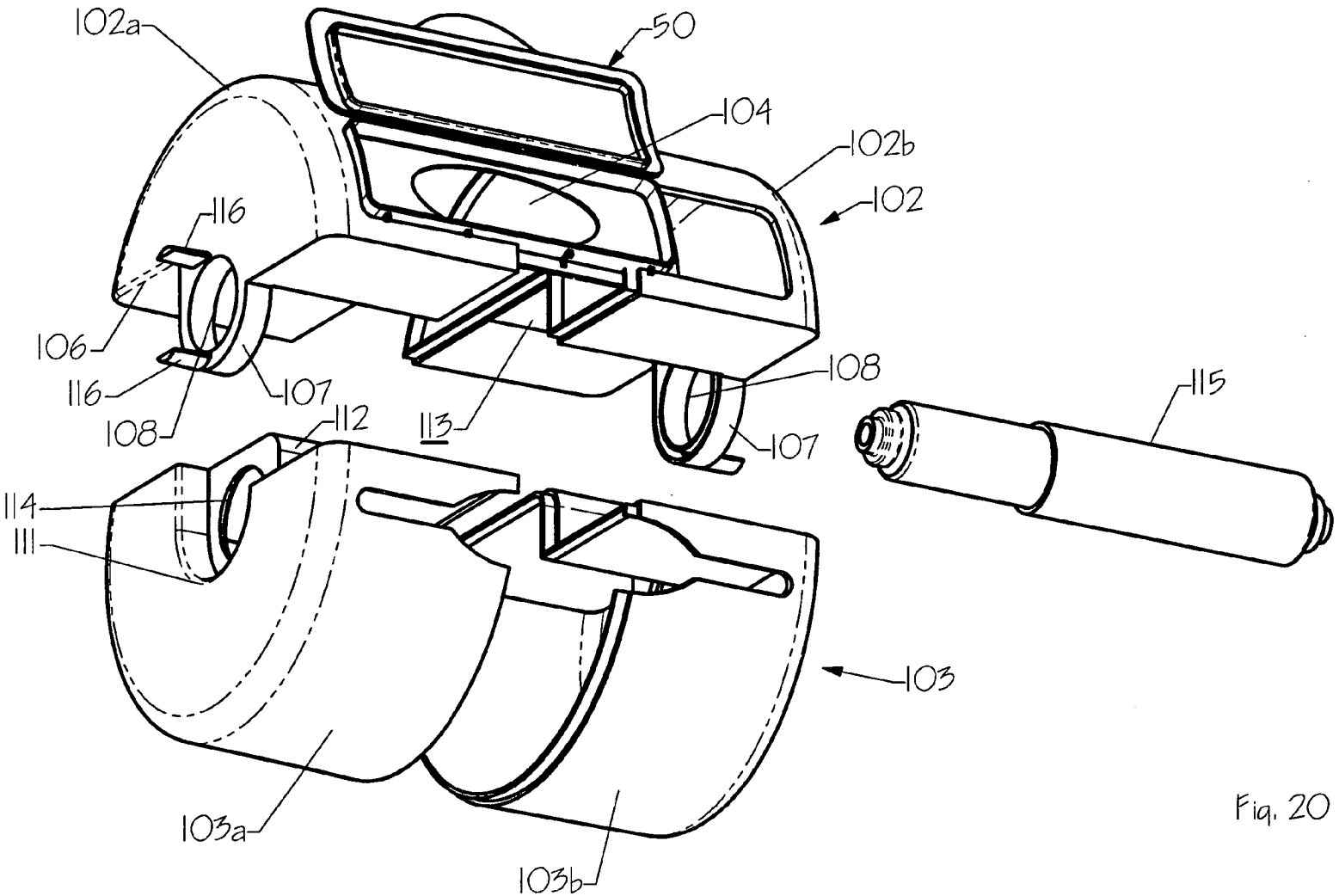
FIG. 20 is an exploded front perspective view from below of a wet paper and a dry paper canister of a second embodiment.
Figure 21:
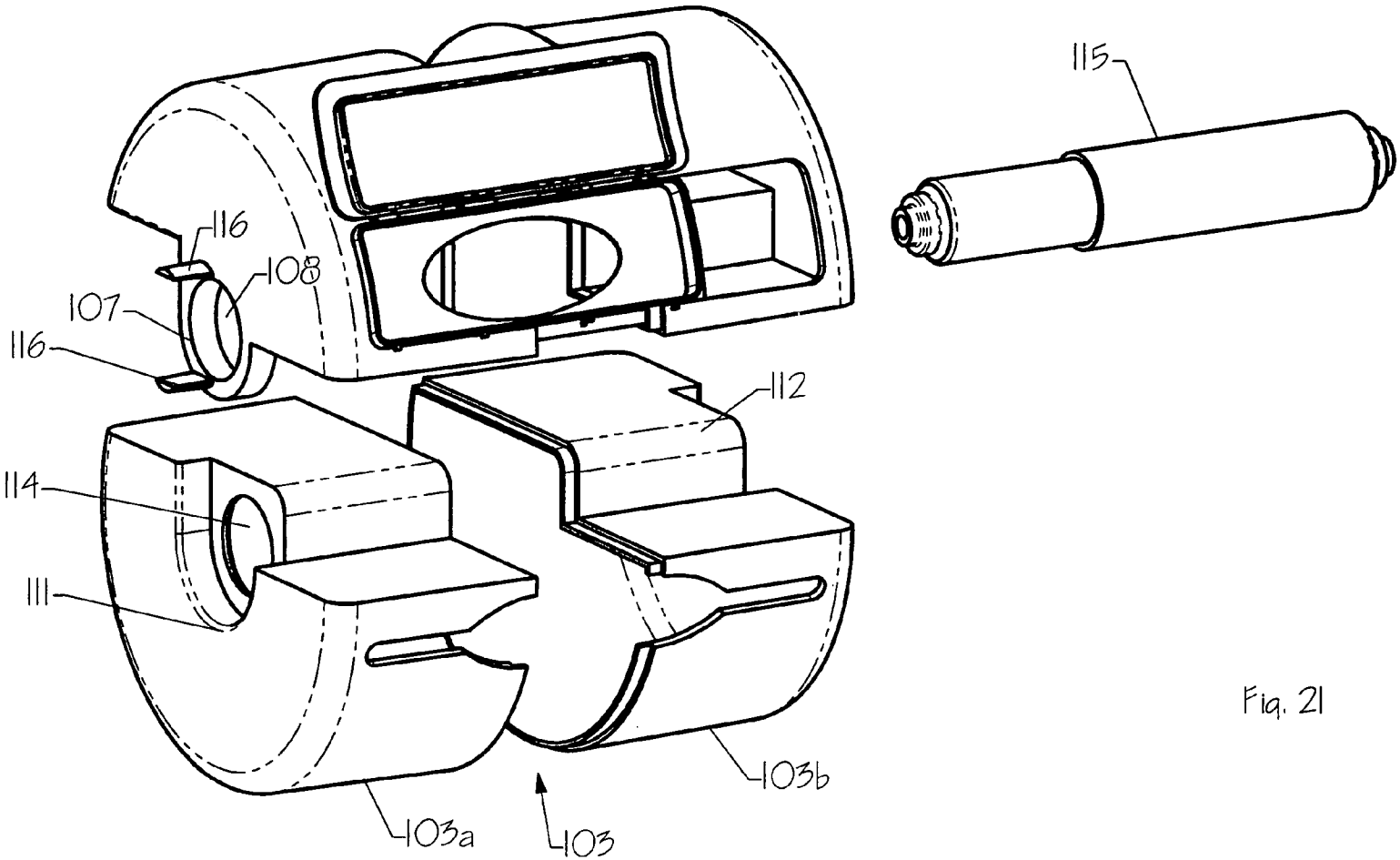
FIG. 21 is similar to FIG. 20 but viewed from above.
Figure 22:
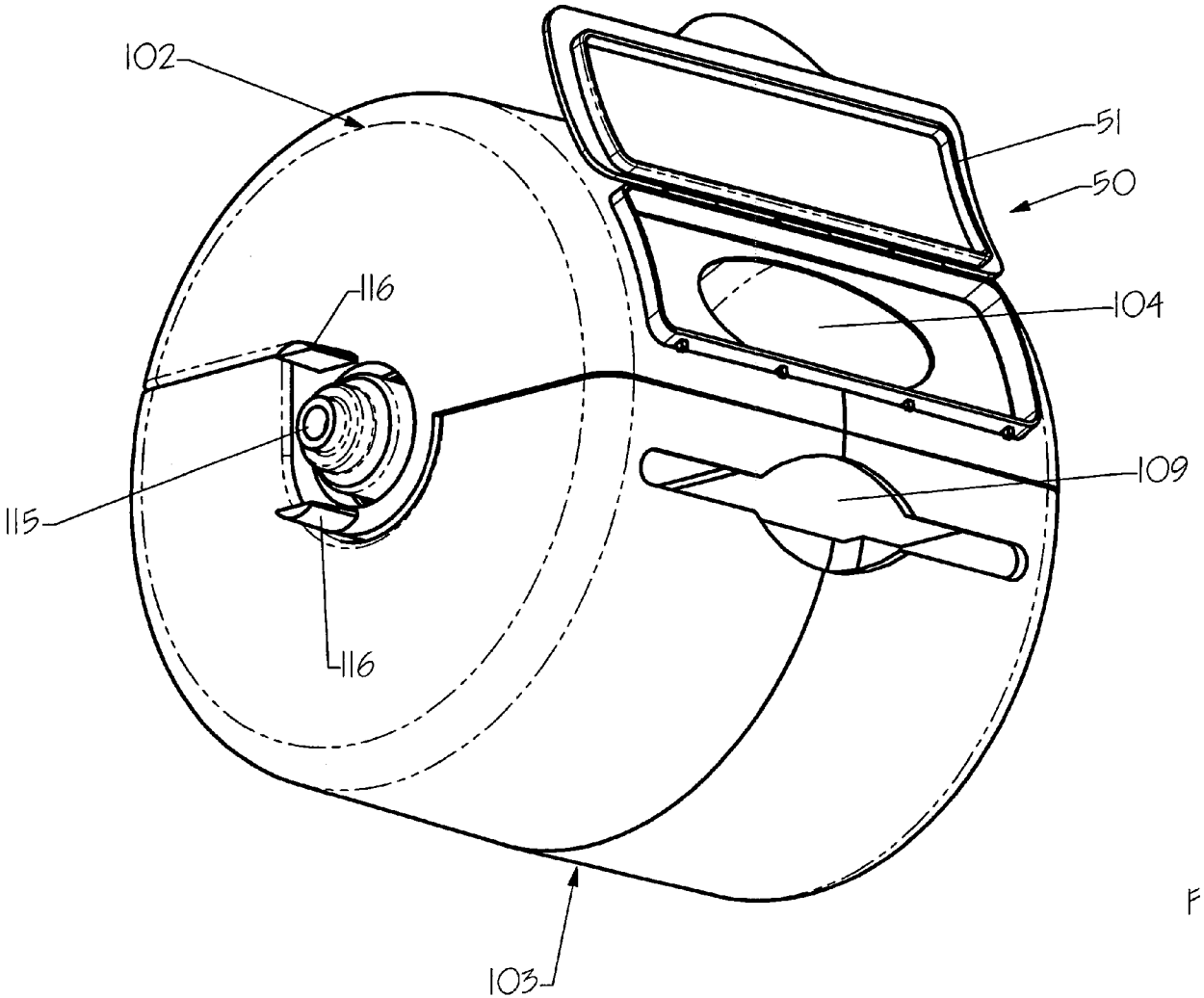
FIG. 22 shows the wet and dry paper canisters of the second embodiment assembled in readiness for installation in the holder.
Figure 23:
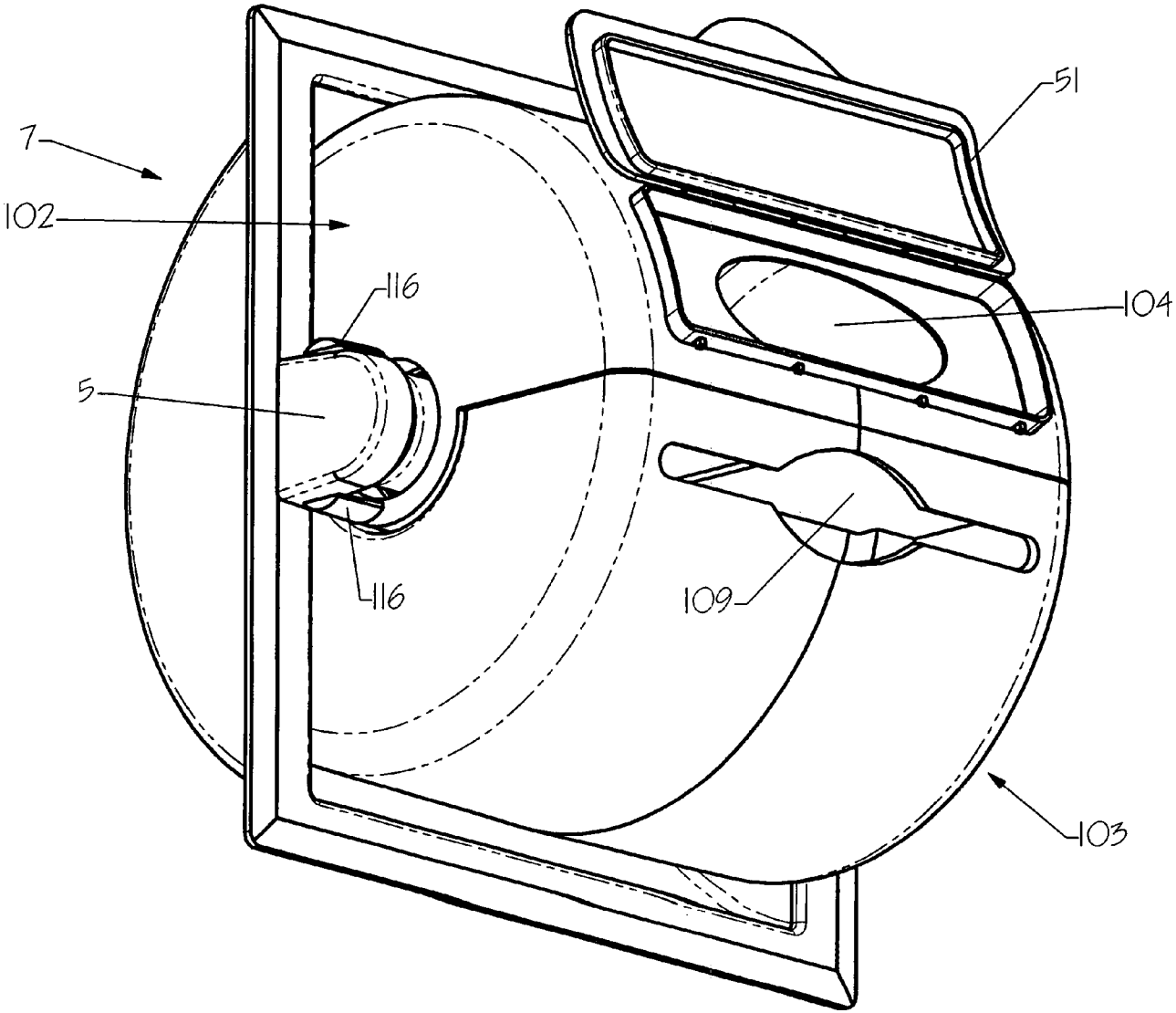
FIG. 23 shows the canisters of the second embodiment installed in the holder.

Reference is next be made to FIGS. 20-22 which show a second embodiment according to the invention.

The second embodiment is similar to the first embodiment in that it comprises canisters for wet and dry paper which when assembled form a cylindrical configuration similar to a conventional roll of toilet paper.

This embodiment departs from the first embodiment by eliminating the shelf thereof and by utilizing a rod or holder which is similar to or the same as a conventional holder for a roll of toilet paper.

The same reference numerals will be used to designate the same elements as in the first embodiment.

FIG. 20 shows canister 102 for wet paper and canister 103 for dry paper. The wet paper canister 102 is a closed body which contains the wet paper in an arrangement in which the wet paper can be extracted through opening 104 as in the previous embodiment either continuously or sheet by sheet depending on how the paper is packed in the canister. The canister 102 is made in two parts 102*a* and 102*b* which are slidably fitted together to form the completed canister 102. In this way, the wet paper canister can be refilled when it is empty. The completed canister 102 has a closed bottom wall 105 with a step 106. A pair of lugs 107 extend downwardly at the opposite sides of canister 102 and the lugs have holes 108 which are aligned with one another. Mounted at the opening 104 is the closable door assembly 50.

The canister 103 for dry paper is also a closed body and it contains dry paper in an arrangement in which the paper can be removed through the opening 109 (see FIG. 22) either sheet by sheet or continously depending on how the paper is packed in the canister. The canister 103 is also made in two parts, 103*a* and 103*b* which are slidably fitted together to form the completed canister 103. In this way, the dry paper canister can be re-filled with paper when it is empty. The canister 103 for dry paper has U-shaped cut-outs at its sidewalls which conform to the lugs 107 on the wet paper canister to receive the lugs when the canisters are abutted against one another as shown in FIG. 22. The upper wall of the canister is formed with a raised block-like portion 112 which fits into a hollow 113 in the wet paper canister in correspondence with step 106. When the canisters are interfitted, the block-like portion 112 fits into hollow 113. The block-like portion 112 has a bore 114 extending therethrough which is aligned with the holes 108 in lugs 107 when the canisters are interfitted.

A telescopic rod or holder 115, similar or the same as a conventional holder for a roll of toilet paper, is engaged in the aligned holes 108, and bore 114 to hold the canisters 102 and 103 together.

The telescopic holder 115 is then installed in lugs 5 and 6 in the same manner as mounting the conventional toilet paper holder, namely by telescoping the ends of the holder inwardly until they engage in the blind bores in the lugs 5 and 6.

In order to secure the assembled canisters against rotation, the lugs 107 are provided with spaced outwardly projecting tabs 116 which engage lugs 5 and 6 at top and bottom and prevent rotation of the canister assembly relative to the lugs.

Figure 24:
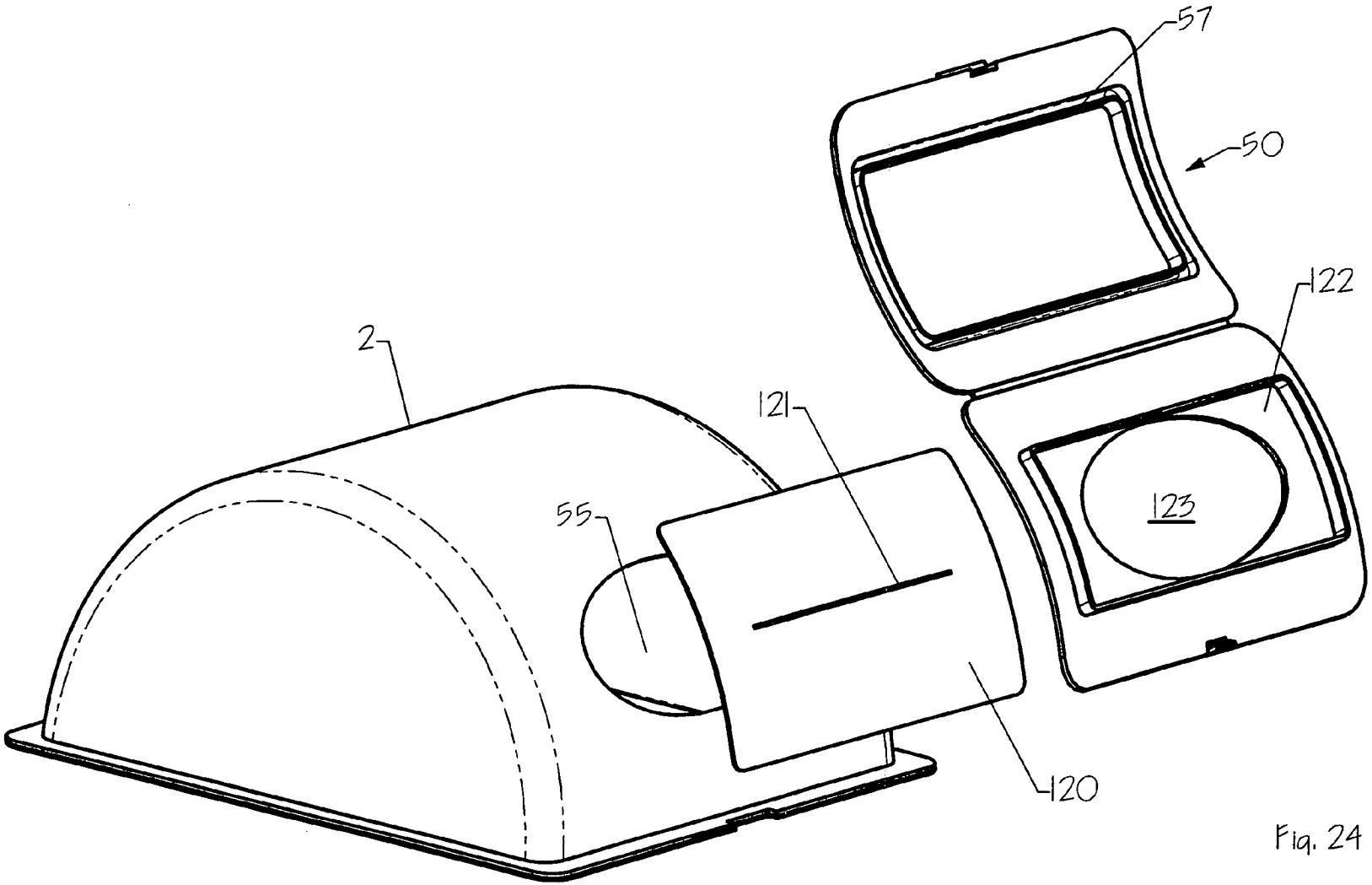
FIG. 24 is an exploded view of a modification of the wet paper canister illustrated in FIG. 17.
Figure 25:
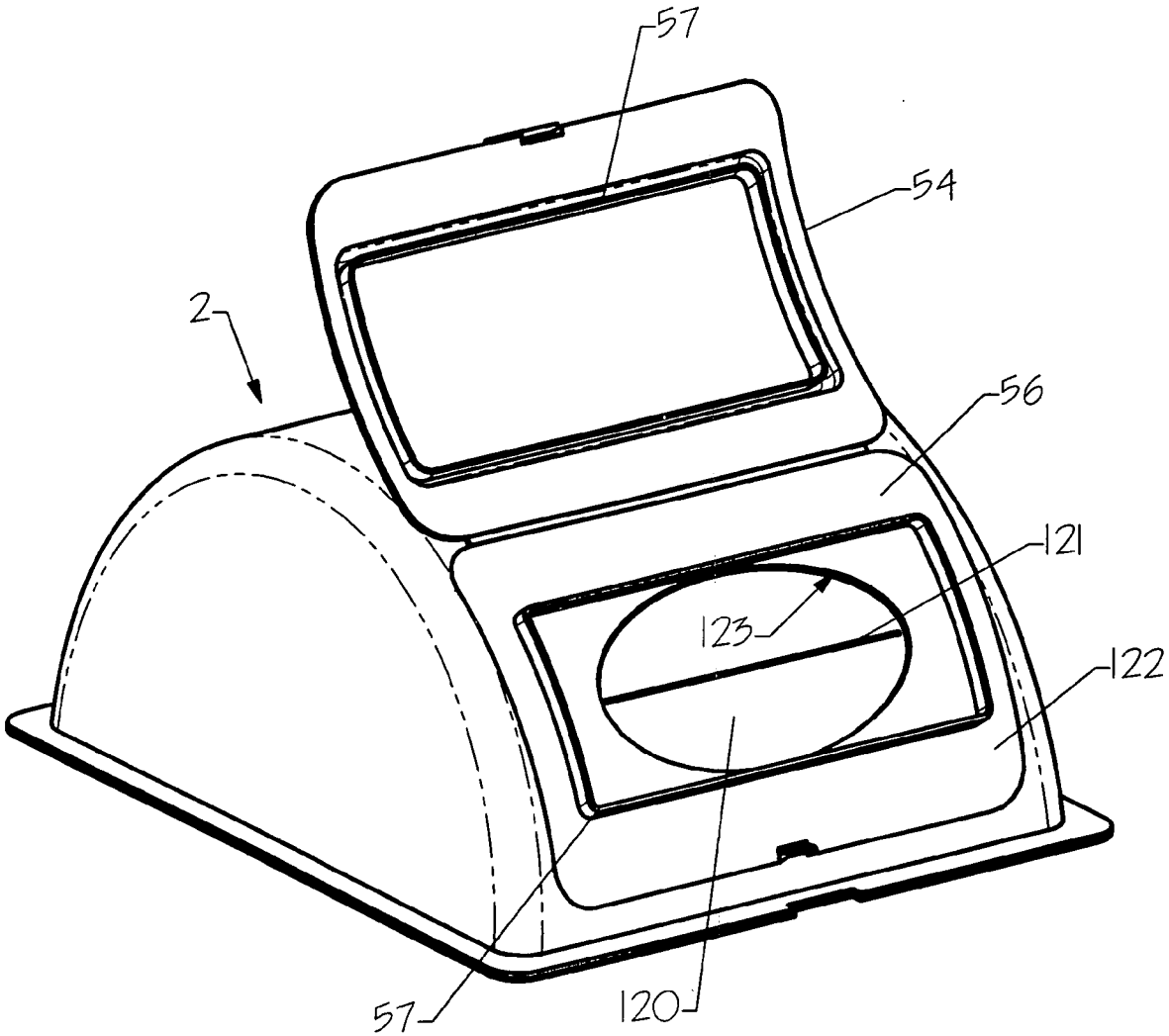
FIG. 25 shows the assembled canister in FIG. 24.

FIGS. 24 and 25 show a modification of the wet paper canister 2 of FIG. 17 adapted to further prevent evaporation of liquid from the wet paper.

As shown in FIG. 24, an additional moisture barrier is formed over the opening 55 in canister 2. The moisture barrier is in the form of a thin soft, pliable plastic film 120 of a thickness of the order of 0.003" to 0.005". The film 120 has a slit 121 extending horizontally in the film to cover opening 55. The film 120 is secured by adhesive or other means to the cover of canister 2 and the frame 56 of the door assembly 50 whereby the film 120 is sandwiched between the frame 56 and the cover of canister 2 as seen in FIG. 25. The frame 56 is provided with an impermeable membrane 122 forming a shield with an opening 123 through which the slit 121 in film 120 is accessible. In this way, the wet paper is removed by the user from the canister 2 by inserting his or her hand through opening 123 in the frame and reaching through the slit 121 to grasp the next sheet of wet paper to be removed. Evaporation of moisture is prevented by film 120 in addition to seals 57.

Although numerous modifications and variations of the disclosed embodiments will become evident to those skilled in the art, these will fall within the scope and spirit of the invention if they are defined within the appended claims. Thus, for example, although the housing has been described as being cylindrical, it can be slightly out-of-round or of other shape within the scope of the invention.

What is claimed is:

1. A dispenser for separate dispensing of wet and dry paper comprising:

a common housing formed by a first canister for wet paper and a second canister for dry paper, said first and second canisters being shaped to provide said housing with the shape of a toilet paper roll of predominantly cylindrical shape in which the wet paper and the dry paper can be separately dispensed.

2. The dispenser of claim 1, wherein the wet paper is encapsulated in the first canister to prevent evaporation.

3. The dispenser of claim 1, wherein the housing has a central opening for receiving a toilet paper holder.

4. The dispenser of claim 1, wherein the first and second canisters have separate dispensing openings for the wet paper and the dry paper, respectively.

5. The dispenser of claim 4, wherein the wet paper and the dry paper are isolated in their respective canisters so that they cannot contact one another.

6. The dispenser of claim 1, wherein said housing includes means for engaging brackets for a toilet paper holder to secure the housing to the brackets.

7. The dispenser of claim 1, further comprising means for securing said housing to a support.

8. A dispenser for wet and dry paper comprising:

a housing including a first canister for wet paper and a second canister for dry paper, said first and second canisters being separate and provided with their respective papers in isolation from one another for being removed in use from the respective canister through a dispensing opening therein;

said canisters being coupled together to define said housing; and means for connecting said housing to brackets of toilet paper holders to secure said first and second canisters to said brackets and permit separate dispensing of the wet and dry paper from their respective said dispensing openings.

9. The dispenser of claim 8, wherein said canisters are fixedly secured in position when said housing is connected to said brackets.

10. The dispenser of claim 9, wherein said canisters are shaped to provide a cylindrical outline for said housing.

11. The dispenser of claim 8, wherein each canister has an opening from which the paper therein can be dispensed.

12. The dispenser of claim 11, wherein the first canister with the wet paper includes an openable cover which seals the opening in the canister in closed position.

13. The dispenser of claim 12 comprising a barrier to prevent evaporation of moisture from the wet paper, said barrier covering the opening in the wet paper canister.

14. The dispenser of claim 13, wherein said barrier comprises a thin pliable film having a slit therein providing access to said opening in the wet paper canister.

15. The dispenser of claim 14 further comprising an openable cover for sealing the opening in the wet paper canister when the cover is closed.

16. The dispenser of claim 14, wherein said film is sandwiched between a frame of the cover and the wet paper canister.

17. The dispenser of claim 8, wherein said first and second canisters have holes which are aligned when the canisters are engaged with one another, and said means for engaging the housing with the brackets comprises an elastically telescoping holder engaged in said holes for elastically engaging in holes in the brackets.

18. The dispenser of claim 17 comprising laterally extending tabs on said housing for engaging the brackets to oppose rotation of the housing with respect to the brackets.

19. A method for separate dispensing of wet paper and dry paper from a common dispenser comprising:

providing a first canister containing wet paper, the canister having an opening from which the wet paper can be removed;

providing a second canister containing dry paper, the second canister having an opening from which the dry paper can be removed;

assembling said canisters and mounting them in holes in brackets normally used for supporting a toilet paper holder;

detachably connecting the first and second canisters in such assembly with the openings thereof facing forwardly; and forming said canisters with domes of semi-cylindrical shape so that when the canisters are mounted on the brackets the canisters form a cylindrical shape.

20. The method of claim 19, wherein said first canister for wet paper forms a hermetic enclosure for said wet paper.

21. The method of claim 19 comprising forming said canisters such that they can be interchangeably mounted on the top or bottom of the assembly.

22. The method of claim 19, wherein the assembled canisters of cylindrical shape have an outline for being inserted into a recess of a holder mounted in a wall.

23. A dispenser for wet and dry paper comprising:

a housing including a first canister for wet paper and a second canister for dry paper, said first and second canisters being separate and provided with their respective papers in isolation from one another for being removed in use from the respective canister through a dispensing opening therein;

said canisters being coupled together to define said housing; and means for connecting said housing to a support means to secure said first and second canisters to said support means and permit separate dispensing of the wet and dry paper from their respective said dispensing openings.

24. The dispenser of claim 23, wherein said canisters are fixedly secured in position when said housing is connected to said support means.

25. The dispenser of claim 23, wherein said canisters are each of dome shape and collectively provide a round outline for said housing.

26. The dispenser of claim 23, wherein each canister has an opening from which the paper therein can be dispensed.

27. A method for separate dispensing of wet paper and dry paper from a common dispenser comprising:

providing a first canister containing wet paper, the canister having an opening from which the wet paper can be removed;

providing a second canister containing dry paper, the second canister having an opening from which the dry paper can be removed;

assembling said canisters and mounting them on a support means;

detachably connecting the first and second canisters in such assembly with the openings thereof facing forwardly; and forming said canisters as domes so that when the canisters are mounted on the support means the canisters form a round outline.

28. The method of claim 27, wherein said first canister for wet paper forms a hermetic enclosure for said wet paper.

29. The method of claim 27, comprising forming said canisters such that they can be interchangeably mounted on the top or bottom of the assembly.

30. The method of claim 27, wherein the assembled canisters of round outline are shaped for being inserted into a recess of a holder mounted to a wall.

* * * * *